US007645349B2

(12) United States Patent
Fujimori et al.

(10) Patent No.: US 7,645,349 B2
(45) Date of Patent: Jan. 12, 2010

(54) SINTERED R-FE-B PERMANENT MAGNET AND ITS PRODUCTION METHOD

(75) Inventors: Nobuhiko Fujimori, Saitama-ken (JP); Kazuhiro Sonoda, Saitama-ken (JP); Takashi Tsukada, Saitama-ken (JP); Junji Matsushima, Saitama-ken (JP); Yasushi Kimura, Saitama-ken (JP); Satoru Kikuchi, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 476 days.

(21) Appl. No.: 11/548,101

(22) Filed: Oct. 10, 2006

(65) Prior Publication Data

US 2008/0017277 A1 Jan. 24, 2008

Related U.S. Application Data

(62) Division of application No. 10/680,139, filed on Oct. 8, 2003, now abandoned.

(30) Foreign Application Priority Data

Oct. 8, 2002 (JP) ..... 2002-294431
Dec. 13, 2002 (JP) ..... 2002-362391

(51) Int. Cl.
*H01F 1/053* (2006.01)
*H01F 1/057* (2006.01)

(52) U.S. Cl. ..... 148/103; 419/12; 419/38; 75/244; 75/246

(58) Field of Classification Search ..... None
See application file for complete search history.

(56) References Cited

U.S. PATENT DOCUMENTS 3,366,995 A 2/1968 Dijken et al.
4,497,722 A * 2/1985 Tsuchida et al. ..... 252/62.54
4,814,139 A 3/1989 Tokunaga et al.
4,983,232 A 1/1991 Endoh et al.
5,100,485 A 3/1992 Yamashita et al.
5,194,098 A * 3/1993 Sagawa et al. ..... 148/302
5,645,651 A 7/1997 Fujimura et al.
6,312,494 B1 11/2001 Tokoro et al.
6,475,302 B2 11/2002 Mei et al.
6,537,345 B1 * 3/2003 Terada et al. ..... 75/392
6,599,450 B1 * 7/2003 Terada et al. ..... 264/37.1
7,156,928 B2 * 1/2007 Hamada et al. ..... 148/302
2004/0025975 A1 2/2004 Nobutoki et al.

FOREIGN PATENT DOCUMENTS

DE 100 32 515 A1 1/2001
JP 59-163803 9/1984
JP 60-027105 2/1985
JP 61-42102 2/1986
JP 3171426 * 7/1991
JP 05-182813 7/1993

(Continued)

*Primary Examiner*—John P. Sheehan
(74) *Attorney, Agent, or Firm*—Sughrue Mion, PLLC

(57) ABSTRACT

A sintered permanent magnet having a composition comprising, by mass, 27-33.5% of R, which is at least one of rare earth elements including Y, 0.5-2% of B, 0.002-0.15% of N, 0.25% or less of O, 0.15% or less of C, and 0.001-0.05% of P, the balance being Fe, wherein it is in the shape of a ring having an outer diameter of 10-100 mm, an inner diameter of 8-96 mm, and a height of 10-70 mm, with a plurality of magnetic poles axially extending on an outer circumferential surface. The distribution of a surface magnetic flux density $B_0$ on magnetic poles in an axial direction of the ring magnet is in a range of 92.5% or more of the maximum of $B_0$.

2 Claims, 11 Drawing Sheets

FOREIGN PATENT DOCUMENTS

| | | |
|---|---|---|
| JP | 7-57914 | 3/1995 |
| JP | 09-027409 | 1/1997 |
| JP | 09-28409 | 1/1997 |
| JP | 9-275004 | 10/1997 |
| JP | 11-214216 | 8/1999 |
| WO | WO 01/24202 A1 | 4/2001 |

* cited by examiner

Line Analysis of EPMA
Example 4

Beam Diameter : 1μm

Line Analysis of EPMA
Comparative Example 4

Beam Diameter : 1μm

Line Analysis of EPMA
Example 9

Line Analysis of EPMA
Comparative Example 9

SINTERED R-FE-B PERMANENT MAGNET AND ITS PRODUCTION METHOD

This is a divisional of application Ser. No. 10/680,139 filed Oct. 8, 2003, now abandoned. The entire disclosure(s) of the prior application(s), application Ser. No. 10/680,139 based on Japanese application numbers JP 2002-362391 filed Dec. 13, 2002 and JP 2002-294431 filed Oct. 8, 2002 is/are considered part of the disclosure of the accompanying application and is/are hereby incorporated by reference.

FIELD OF THE INVENTION

The present invention relates to radially anisotropic sintered R—Fe—B permanent magnet and its production method, particularly to a high-performance, radially anisotropic sintered R—Fe—B permanent magnet excellent in the uniformity of a surface magnetic flux density, and its efficient production method.

BACKGROUND OF THE INVENTION

R—Fe—B permanent magnets have been produced for many years by so-called dry molding methods, in which dry fine powder is molded in a die while applying a magnetic field. In the dry molding method the concentration of oxygen in a nitrogen or Ar gas, a pulverization medium, is usually controlled in a desired range by introducing a trace amount of oxygen into a jet mill in the fine pulverization of a coarse starting material powder in the jet mill. This is to cause the oxidization of fine powder surfaces. Finely pulverized powder would be burned without this oxidation treatment, when brought into contact with the air. The fine powder subjected to the oxidation treatment has an oxygen content of 5000-6000 ppm, and the sintered body obtained from this fine powder has an oxygen content of 4000-5000 ppm. Most of oxygen in the sintered body is bonded to rare earth elements such as Nd, etc., existing as oxides in the grain boundaries. To supplement an oxidized part of the rare earth elements, the total amount of rare earth elements in the sintered body should be increased, resulting in decrease in the saturation magnetic flux density of the sintered magnet.

To solve the problems of the dry molding method, JP 7-57914 A proposes a method for producing a sintering rare earth magnet comprising the steps of injecting a mixture of rare earth magnet powder and a mineral oil or a synthetic oil under pressure into a die cavity, to which an oriented magnetic field is applied, wet-molding it in a magnetic field in a low-oxygen atmosphere to form a ring-shaped green body, removing the solvent from the green body, and sintering the green body in vacuum. This method can stably produce high-performance, sintered R—Fe—B permanent magnets having a small total amount of rare earth elements and a small oxygen content. However, because the slurry is injected under pressure into the die cavity, to which the oriented magnetic field is applied, the fine R—Fe—B powder having large spontaneous magnetization oriented is subjected to large constraint by interaction with the oriented magnetic field, resulting in a nonuniform filling density in the die cavity. As a result, the resultant green body has a nonuniform density, causing deformation and cracking in the resultant sintered body. Also, because the slurry is injected into the die cavity under pressure toward a core center through an injection aperture open in the die cavity, the slurry impinging the core is divided to flows in two directions, which are converged on the opposite side of the injection aperture by 180°, so that the resultant sintered body has cracks generated from this converging position.

JP 11-214216 A proposes a method for producing a sintered R—Fe—B permanent magnet comprising the steps of ejecting a slurry of an R—Fe—B permanent magnet powder and a solvent such as a mineral oil, a synthetic oil or a vegetable oil through a slurry-supplying pipe inserted into a die cavity, to which a magnetic field is applied, molding the slurry filled in the cavity under pressure while gradually withdrawing the slurry-supplying pipe from the cavity, removing the solvent from the resultant ring-shaped green body, and sintering the green body. Because the slurry is injected into the die cavity through the slurry-supplying pipe inserted deep into the die cavity in this method, the die cavity is filled with the slurry at a good filling ratio even in the case of molding a relatively long ring-shaped green body. However, because the slurry-supplying pipe is inserted deep into the die cavity and withdrawn while ejecting the slurry, this method is disadvantageous in a long supplying time of the slurry. In addition, the slurry-supplying pipe leaves a void in the resultant green body at a position thereof, and this void acts as a starting position of cracking in the resultant sintered permanent magnet.

Proposed as another method for producing a radially anisotropic ring-shaped R—Fe—B permanent magnet is a method comprising the steps of pulverizing quenched ribbons of an R—Fe—B magnet alloy, molding the resultant powder at room temperature, hot-pressing the resultant green body in an inert gas atmosphere for densification, hot-plastic-working the resultant hot-pressed body to form a cup body provided with radial magnetic anisotropy, and cutting a bottom portion off to provide a ring-shaped product (JP 9-275004 A, JP 2001-181802 A). However, because the hot plastic working of the hot-pressed body in an inert gas atmosphere is carried out at a relatively low temperature of about 700-800° C. so that crystal grains do not grow too much, it should be conducted at an extremely low speed to prevent cracking. Though different depending on the size of a magnet, one hot plastic working operation usually takes 10-30 minutes, low productivity as an industrial method for producing permanent magnets. In addition, because pressed bodies thus produced are likely to have cracks in their end portions, cracked portions should be cut off. For these reasons, this production method suffers from a high production cost. Further, the resultant ring magnet has large variations of magnetic properties. Though the degree of radial anisotropy depends on how much deformed in the hot plastic working, particularly small-diameter products and long products having large hot plastic working resistance suffer from large variations of a surface magnetic flux density.

OBJECTS OF THE INVENTION

Accordingly, an object of the present invention is to provide a radially anisotropic sintered R—Fe—B permanent magnet free from deformation and cracking and having excellent magnetic orientation.

Another object of the present invention is to provide a method for producing a radially anisotropic sintered R—Fe—B permanent magnet having high magnetic properties with little variation of a surface magnetic flux density at a high productivity.

DISCLOSURE OF THE INVENTION

The sintered permanent magnet of the present invention has a composition comprising, by mass, 27-33.5% of R, which is at least one of rare earth elements including Y, 0.5-2% of B, 0.002-0.15% of N, 0.25% or less of O, 0.15% or less of C, and 0.001-0.05% of P, the balance being Fe, wherein it has a coercivity iHc of 1 MA/m or more. The term "sintered permanent magnet" used herein includes both of sintered bodies made of permanent magnet materials before magnetization and those after magnetization. The coercivity is measured at room temperature (25° C.).

P is preferably 0.003-0.05% by mass, more preferably 0.008-0.05% by mass.

The sintered permanent magnet of the present invention preferably in the shape of a ring having an outer diameter of 10-100 mm, an inner diameter of 8-96 mm, and a height of 10-70 mm, with a plurality of magnetic poles axially extending on an outer circumferential surface. The sintered permanent magnet of the present invention may be a small ring magnet having an outer diameter of 10-30 mm, an inner diameter 8-28 mm and a height of 10-50 mm, particularly an outer diameter of 10-25 mm, an inner diameter 8-23 mm and a height of 10-40 mm. The sintered permanent magnet of the present invention is preferably a radially anisotropic sintered R—Fe—B permanent magnet. The sintered permanent magnet of the present invention preferably has a density of 7.52-7.85 g/cm$^3$.

A distribution of a surface magnetic flux density $B_0$ along the axial magnetic pole in the above ring magnet is preferably in a range of 92.5% or more of the maximum of $B_0$. Namely, the variation of a surface magnetic flux density $B_0$ in the axial direction of the ring magnet is preferably 7.5% or less of the maximum of $B_0$. Here, the variation of a surface magnetic flux density $B_0$ is represented by the formula of [(maximum of $B_0$−minimum of $B_0$)/maximum of $B_0$]×100(%). The maximum and minimum of $B_0$ are measured in a range of a height H of the ring magnet. The distribution of a surface magnetic flux density $B_0$ is measured by placing a probe of a Gauss meter opposite to an outer circumferential surface of the ring magnet perpendicularly, and moving it on the outer circumferential surface in the axial direction of the ring magnet (length direction). The variation of a surface magnetic flux density $B_0$ is more preferably within 5%, particularly within 3%.

In one embodiment of the present invention, R is 27-32% by mass. In another embodiment of the present invention, R is more than 32% and 33.5% or less by mass. In the latter case, the sintered permanent magnet of the present invention has a composition comprising, by mass, more than 32% and 33.5% or less of R, which is at least one of rare earth elements including Y, 0.5-2% of B, more than 0.25% and 0.6% or less of O, 0.0.1-0.15% of C, 0.002-0.05% of N, and 0.001-0.05% of P, the balance being Fe, wherein it is in the shape of a ring having an outer diameter of 10-100 mm, an inner diameter of 8-96 mm, and a height of 10-70 mm, wherein it has magnetic anisotropy in a circumferential direction of the ring, and wherein a distribution of a surface magnetic flux density $B_0$ on magnetic pole in the axial direction of the ring is in a range of 92.5% or more of the maximum of $B_0$. In this case, too, the variation of a surface magnetic flux density $B_0$ is preferably within 7.5%, more preferably within 5%, particularly within 3%. This sintered penrman.ent magnet preferably has a density of 7.42-7.75 g/cm$^3$.

In the sintered permanent magnet of the present invention, part of Fe may be replaced by at least one selected from the group consisting of 0-1% of Nb, 0.01-1% of Al, 0-5% of Co, 0.01-0.5% of Ga, and 0-1% of Cu, by mass. Nb is preferably 0.05-1% by mass. Al is preferably 0.01-0.3% by mass. Co is preferably 0.3-5% by mass, more preferably 0.3-4.5% by mass. Ga is preferably 0.03-0.4% by mass. Cu is preferably 0.01-1% by mass, more preferably 0.01-0.3%. by mass.

The first method of the present invention for producing a sintered permanent magnet comprises the steps of (a) pulverizing a rare earth magnet material to fine powder, and recovering said fine powder directly in a mineral oil, a synthetic oil or their mixture to form a slurry, (b) injecting said slurry under pressure into a die cavity, in which said slurry is wet-molded in a magnetic field, (c) heating the resultant green body under reduced pressure to remove said mineral oil, said synthetic oil or their mixture from said green body, and (d) sintering said green body in vacuum, wherein an axial direction of an aperture open in a cavity of said die for injecting said slurry under pressure is deviated from a center of a center core in said die.

The second method of the present invention for producing a sintered permanent magnet comprises the steps of (a) pulverizing a rare earth magnet material to fine powder, and recovering said fine powder directly in a mineral oil, a synthetic oil or their mixture to form a slurry, (b) injecting said slurry under pressure into a die cavity, in which said slurry is wet-molded in a magnetic field, (c) heating the resultant green body under reduced pressure to remove said mineral oil, said synthetic oil or their mixture from said green body, and (d) sintering said green body in vacuum, wherein said mineral oil, said synthetic oil or their mixture is mixed with sodium hypophosphite as a fluidity-improving agent.

The third method of the present invention for producing a sintered permanent magnet comprises the steps of (a) pulverizing a rare earth magnet material to fine powder, and recovering said fine powder directly in a mineral oil, a synthetic oil or their mixture to form a slurry, (b) injecting said slurry under pressure into a die cavity, in which said slurry is wet-molded in a magnetic field, (c,) heating the resultant green body under reduced pressure to remove said mineral oil, said synthetic oil or their mixture from said green body, and (d) sintering said green body in vacuum, wherein an axial direction of an aperture open in a cavity of said die for injecting said slurry under pressure is deviated from a center of a center core in said die, and wherein said mineral oil, said synthetic oil or their mixture is mixed with sodium hypophosphite as a fluidity-improving agent.

Sodium hypophosphite is added preferably in the form of a solution in glycerin or ethanol, though it is possible to dissolve sodium hypophosphite in a non-aqueous solvent instead of forming a solution in glycerin or ethanol. However, from the aspect of easiness in handling a solvent, glycerin or ethanol is desirable as a solvent.

BRIEF DESCRIPTION OF THE DRAWINGS

FIG. 3(*b*) is a horizontal cross-sectional view showing a test piece that is to be cut out from a ring-shaped sintered body;

DETAILED DESCRIPTION OF THE PREFERRED EMBODIMENTS

[1] Composition

Figure 1:
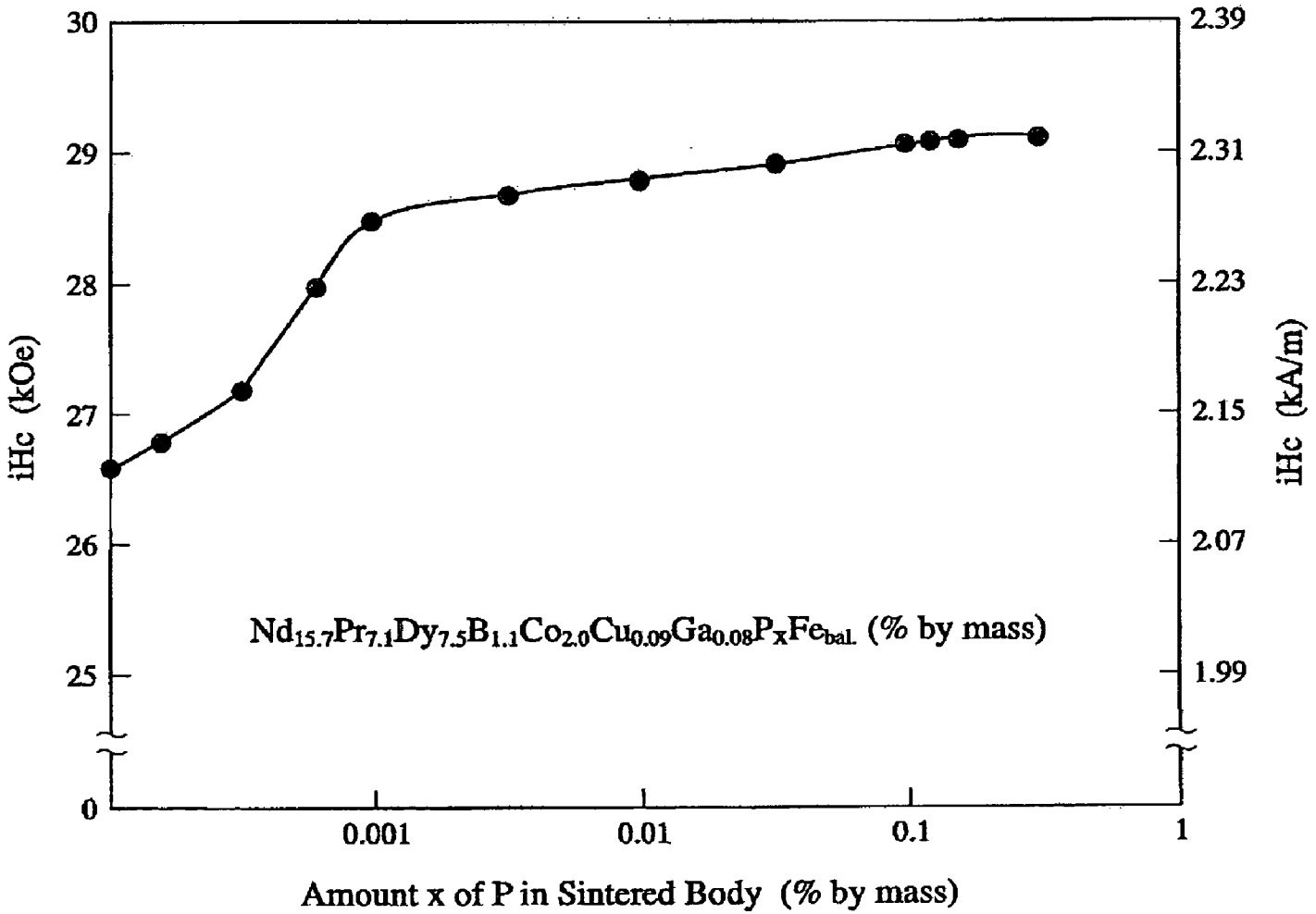
FIG. 1 is a graph showing the relation between the coercivity iHc and the content of P of the sintered permanent magnet.

The sintered permanent magnet of the present invention generally has a composition comprising, by mass, 27-33.5% of R, which is at least one of rare earth elements including Y, 0.5-2% of B, 0.002-0.15% of N, 0.25% or less of O, 0.15% or less of C, and 0.001-0.05% of P, the balance being Fe. The content of each element can be measured by an X-ray fluorescence analysis, etc.

(A) Main Elements (1) Rare Earth Element R

The content of the rare earth element R is generally 27-33.5% by mass. The content of the rare earth element exceeding 33.5% by mass results in decrease in a saturation magnetic flux density and the deterioration of a corrosion resistance. Of the other hand, when the content of the rare earth element is less than 27% by mass, the amount of a liquid phase necessary for the densification of the sintered body is insufficient, resulting in providing the sintered body with low density and coercivity iHc. R is 27-32% by mass in the first preferred composition of the present invention, and R is more than 32% and 33.5% or less by mass in the second preferred composition.

When the content of O is more than 0.25% and 0.6% or less by mass, the amount of the rare earth element R is preferably more than 32% and 33.5% or less by mass. When the amount of the rare earth element exceeds 33.5% by mass, the amount of a rare earth-rich phase in the sintered body increases, accompanied by increase in its size, thus resulting in the deterioration of a corrosion resistance. On the other hand, when the amount of the rare earth element is 32% or less by mass, the amount of a liquid phase necessary for the densification of the sintered body is insufficient, thereby providing the sintered body with decreased density, as well as a decreased residual magnetic flux density Br and decreased coercivity iHc among magnetic properties. In the case of a sintered permanent magnet needing a high corrosion resistance, R is preferably limited to 32% or less by mass.

(2) Boron B

The content of B is generally 0.5-2% by mass. When the content of B is less than 0.5% by mass, B necessary for the formation of an $R_2Fe_{14}B$ phase, a main phase, is insufficient, and an $R_2Fe_{17}$ phase having soft magnetic properties is formed, resulting in decrease in coercivity iHc. On the other hand, when the content of B exceeds 2% by mass, a B-rich phase, non-magnetic phase, increases, resulting in decrease in a residual magnetic flux density Br.

(3) Nitrogen N

The content of N is generally 0.002-0.15% by mass. N exists mainly in an R-rich phase in the sintered body, bonding to part of the rare earth element to form nitrides. It is presumed that the formation of nitrides suppresses the anodic oxidation of a grain boundary phase, improving the corrosion resistance of the sintered body. However, when the content of N exceeds 0.15% by mass, the formation of nitrides decreases the amount of rare earth elements necessary for having the coercivity iHc, resulting in decrease in the coercivity iHc. On the other hand, when the content of N is less than 0.002% by mass, the sintered body has a low corrosion resistance. Incidentally, because fine pulverization in an Ar gas atmosphere does not cause nitriding, the content of N is 0.002-0.05% by mass in the sintered body.

In the course of the coarse pulverization of an ingot produced by melting, trace amounts of nitrides are formed by nitrogen in the air. When this coarse powder is finely pulverized by a jet mill in a nitrogen gas or a nitrogen-containing Ar gas, which contains substantially no oxygen, further nitriding takes place. Here, "containing substantially no oxygen" means that the oxygen content is 0.001% or less by mass, more preferably 0.0005% or less by mass, further preferably 0.0002% or less by mass. Accordingly, the amount of coarse powder supplied to the jet mull per a unit time, and a ratio of an Ar gas to a nitrogen gas are adjusted in the fine pulverization, such that the content of N in the resultant sintered body does not exceed 0.15% by mass.

(4) Oxygen O

The content of O is 0.25% or less by mass in the first preferred composition of the present invention, while it is more than 0.25% and 0.6% or less by mass in the second preferred composition of the present invention; When the content of O exceeds 0.6% by mass, part of the rare earth elements form oxides, resulting in too small amounts of the magnetically effective rare earth elements, and thus decrease in a coercivity iHc. Because R is 27-32% by mass in the first composition, the upper limit of the content of O is 0.25% by mass. On the other hand, because R is more than 32% and 33.5% or less by mass in the second composition, the upper limit of the content of O can be 0.6% by mass. With respect to the lower limit of the content of O, it is preferably 0.05% by mass, though not restrictive. Particularly in the first composition, high corrosion resistance can be obtained by limiting the oxygen content and controlling the nitrogen content.

(5) Carbon C

The content of C is generally 0.15% or less by mass. When the content of C is more than 0.15% by mass, part of the rare earth elements form carbides, resulting in decrease in the amount of magnetically effective rare earth elements and thus decrease in a coercivity iHc. The content of C is preferably 0.12% or less by mass, more preferably 0.1% or less by mass. With respect to the lower limit of the content of C, it is preferably 0.01% by mass, though not restrictive.

(6) Phosphorus P

It has been found that the addition of a trace amount of P is effective to improve the coercivity iHc of the R—Fe—B permanent magnet. FIG. 1 shows the change of a coercivity iHc of a sintered body having a composition by mass of 15.7% of Nd, 7.1% ofPr, 7.5% of Dy, 1.1% of B, 2.0% of Co, 0.09% of Cu. 0.08% of Ga, and x % of P, the balance being Fe, relative to the content x of P in the sintered body. Though the improvement of the coercivity iHc is observed when the content of P reaches 0.0005% by mass, it is remarkable at the content of P of 0.001% or more by mass. At 0.001% or more by mass, the larger the content of P, the higher the coercivity iHc. However, when the content of P exceeds 0.05% by mass, the strength of the sintered body is lowered. Accordingly, the content of P in the sintered body is 0.001-0.05% by mass. In this range, no decrease in saturation magnetization is appreciated.

Though it is not necessarily clear why the coercivity iHc is improved by P, it is presumed that P exists in pinning sites for fixing magnetic domain walls in interfaces between a grain boundary phase and a main phase of crystal grains in the sintered body, thereby changing the composition or morphology of the pinning sites, which leads to increase in the fixing force of the magnetic domain walls.

The lower limit of the content of P is preferably 0.003% by mass, more preferably 0.008% by mass. The upper limit of the content of P is preferably 0.04% by mass, more preferably 0.02% by mass.

Though not particularly restrictive, methods for controlling the content of P may be (1) a method of mixing Fe alloys, starting material metals for an ingot for an R—Fe—B permanent magnet, with P-containing Fe-base alloys having known P contents, such as Fe—P alloys or Fe—B—P alloys, etc. in predetermined amounts to control the content of P in the ingot; (2) a method of coarsely pulverizing an ingot produced by vacuum melting for an R—Fe—B permanent magnet, mixing the resultant coarse powder of 20-500 μm with a predetermined amount of sodium hypophosphite ($NaPH_2O_2$) in the form of a solution such as an aqueous solution, and drying the powder, thereby controlling the content of P in the coarse powder for the R—Fe—B permanent magnet; and (3) a method of adding sodium hypophosphite as a fluidity-improving agent in the form of a solution in glycerin or ethanol to a mineral oil, a synthetic oil or their mixture for forming a sintered powder slurry, such that the percentage of sodium hypophosphite is 0.01% or more by mass, and wet-molding the slurry. When a green body is efficiently produced by a wet-molding method, while preventing the oxidation of sintered powder, the method (3) is most preferable.

In the method (3), the addition of such a sodium hypophosphite solution as to make the content of P less than 0.001% by mass provides only an insufficient effect of improving the fluidity of the slurry. It is preferable to control the amount of a solution of sodium hypophosphite in glycerin or ethanol, such that the ratio of sodium hypophosphite to a mineral oil, a synthetic oil or their mixture does not exceed 0.5% by mass.

(B) Optional Elements

In the sintered permanent magnet of the present invention, part of Fe may be replaced by at least one selected from the group consisting of Co, Nb, Al, Ga and Cu. The amount of each substituting element is expressed by percentage by mass per the overall sintered permanent magnet.

(1) Cobalt Co

The amount of Co is generally 0-5% or less by mass. Co functions to elevate the Curie temperature of the sintered magnet, namely, to improve the temperature coefficient of saturation magnetization. However, when the amount of Co exceeds 5% by mass, the sintered magnet has drastically decreased residual magnetic flux density Br and coercivity iHc. The amount of Co added is preferably 0.3-5% by mass, particularly 0.3-4.5% by mass. When the amount of Co is less than 0.3% by mass, there is only a small effect of improving the temperature coefficient.

(2) Niobium Nb

The amount of Nb is generally 0-1% by mass. A Nb boride formed in the sintering process suppresses the abnormal growth of crystal grains. However, when the amount of Nb exceeds 1% by mass, a large amount of the Nb boride is formed, resulting in decrease in a residual magnetic flux density Br. When the amount of Nb is less than 0.05% by mass, there is only an insufficient effect of suppressing the abnormal growth of crystal grains. Accordingly, the preferred amount of Nb replacing Fe is 0.05-1% by mass.

(3) Aluminum Al

The amount of Al is generally 0.01-1% by mass. Al has an effect of increasing a coercivity iHc. When the amount of Al is less than 0.01% by mass, there is only an insufficient effect of improving the coercivity iHc. On the other hand, when the amount of Al exceeds 1% by mass, the residual magnetic flux density Br decreases drastically. The upper limit of the Al content is preferably 0.3% by mass.

(4) Gallium Ga

The amount of Ga is generally 0.01-0.5% by mass. Though a trace amount of Ga has an effect of improving a coercivity iHc, such effect would be insufficient if the amount of Ga were less than 0.01% by mass. On the other hand, when the amount of Ga exceeds 0.5% by mass, the decrease of the residual magnetic flux density Br becomes remarkable, and the coercivity iHc also decreases. The amount of Ga is preferably 0.03-0.40% by mass, more preferably 0.03-0.2% by mass.

(5) Copper Cu

The amount of Cu is generally 0-1% by mass. Though a trace amount of Cu has an effect of providing the sintered magnet with an improved coercivity iHc, such effect would be saturated if the amount of Cu added exceeded 1% by mass. When the amount of Cu added is less than 0.01%. by mass, there is only an insufficient effect of improving the coercivity iHc. Thus, the amount of Cu is preferably 0.01-1% by mass, more preferably 0.01-0.3% by mass.

The sintered permanent magnet according to the first embodiment of the present invention has a composition comprising, by mass, 27-32% of R, 0.5-2% of B, 0.002-0.15% of N, 0.05-0.25% of O, 0.01-0.15% of C, and 0.001-0.05% of P, the balance being Fe.

The sintered permanent magnet according to the second embodiment of the present invention has a composition comprising, by mass, more than 32% and 33.5% or less of R, 0.5-2% of B, 0.002-0.05% of N, more than 0.25% and 0.6% or less of O, 0.01-0.15% of C, and 0.001-0.05% of P, the balance being Fe. The sintered body having this composition can be produced from a slurry obtained by mixing dry fine powder pulverized in an atmosphere having an oxygen content of 0.005-0.5% with a mineral oil, a synthetic oil or their mixture.

In the sintered permanent magnets in any embodiments, part of Fe may be replaced by at least one selected from the group consisting of 0.3-5% of Co, 0.05-1% of Nb, 0.01-1% of Al, 0.01-0.5% of Ga, and 0.01-1% of Cu, by mass.

[2] Production Method (A) Fine Pulverization

Coarse powder having the above composition for an R—Fe—B permanent magnet is finely pulverized by a jet mill to fine powder having an average diameter of 3-6 μm, (a) in an atmosphere composed of a nitrogen gas and/or an Ar gas, whose oxygen content is substantially 0%, or (b) in an atmosphere composed of a nitrogen gas and/or an Ar gas, whose oxygen content is 0.005-0.5%. To control the amount of N in the sintered body, a trace amount of a nitrogen gas is preferably introduced into a jet mill whose atmosphere is an Ar gas, such that the concentration of a nitrogen gas in the Ar gas is adjusted.

When the jet mill is filled with a nitrogen gas atmosphere, it is preferable to control the amount of N mixed into magnet powder by adjusting the amount of coarse powder charged at the time of pulverization, thereby controlling the amount of N in the resultant sintered body. Incidentally, the phrase that "the oxygen concentration is substantially 0%" means that the present invention is not restricted to a case where the oxygen concentration is completely 0%, but includes a case where the fine powder may contain oxygen in such an amount that the fine powder surface is extremely slightly covered with an oxide layer. Such low oxygen concentration is, for instance, 0.001% or less, preferably 0.0005% or less, more preferably 0.0002% or less.

When the coarse powder containing 0.002-0.15% by mass of N is finely pulverized in an atmosphere having an oxygen content of 0.005-0.5%, the oxidation reaction of the rare earth elements predominantly occurs in the coarse powder, so that a nitriding reaction is almost negligible.

(B) Formation of Slurry

A vessel containing a mineral oil, a synthetic oil or their mixture is disposed at a fine powder-recovering outlet of the jet mill, and this vessel is filled with an atmosphere composed of a nitrogen gas and/or an Ar gas. Thus, the fine powder is recovered directly in a mineral oil, a synthetic oil or their mixture without contact with the air, to form a slurry.

The mineral oil, the synthetic oil or their mixture is preferably mixed with sodium hypophosphite as a fluidity-improving agent. The sodium hypophosphite is preferably added in the form of a solution in glycerin or ethanol to a mineral oil, a synthetic oil or their mixture. Though not particularly restrictive, the concentration of sodium hypophosphite in a solution in glycerin or ethanol is preferably such that the ratio of sodium hypophosphite to a mineral oil, a synthetic oil or their mixture is within a range of 0.01-0.5% by mass. When the ratio of sodium hypophosphite is less than 0.01% by mass, there is only an insufficient effect of improving the fluidity of the slurry. When a mineral oil, a synthetic oil or their mixture is mixed with a solution of sodium hypophosphite in glycerin or ethanol, the mineral oil, the synthetic oil or their mixture becomes acidic, whereby the fine powder recovered in these solvents chemically reacts with sodium hypophosphite.

As a result, the radially anisotropic sintered R—Fe—B permanent magnet obtained from such slurry has an increased content of P. In the radially anisotropic sintered R—Fe—B permanent magnet, P exists mainly in a non-magnetic grain boundary phase rich in rare earth elements. The inventors' research has revealed that the ratio of sodium hypophosphite to a mineral oil, a synthetic oil or their mixture is preferably 0.01-0.5% by mass, such that the content of P in the sintered body is 0.001-0.05% by mass. The addition of a solution of sodium hypophosphite in glycerin or ethanol may be carried out before or after recovering the fine powder in a mineral oil, a synthetic oil or their mixture.

In any case, when the fine powder is mixed with a mineral oil, a synthetic oil or their mixture to form a slurry, the fine powder is prevented from oxidation and nitriding by the effect of a mineral oil, a synthetic oil or their mixture shielding the fine powder from the air. Accordingly, the contents of O and N in the resultant sintered body do not substantially differ from those in the fine powder.

(C) Formation of Slurry

Figure 2:
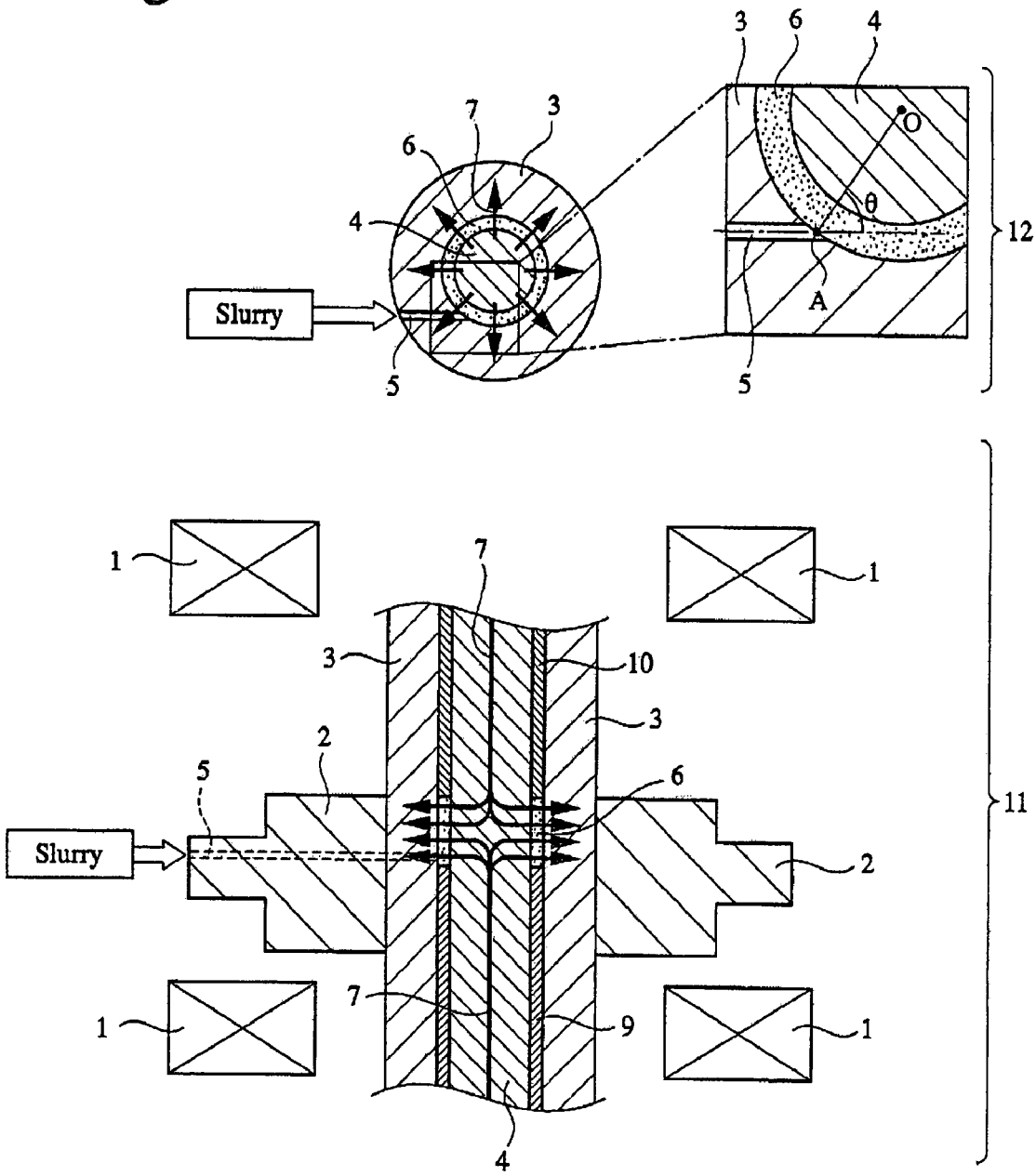
FIG. 2 is a schematic view showing a molding apparatus for conducing the method of the present invention.

FIG. 2 shows an example of molding apparatuses used in the method of the present invention. A region indicated by the reference number 11 shows a vertical cross section of the molding apparatus, and a region indicated by the reference number 12 is a horizontal cross-sectional view showing a die in the molding apparatus, and its enlarged view (square region). The die comprises a solid cylindrical core 4, a hollow cylindrical die member 3, a lower punch 9, and an upper punch 10, a space enclosed by them being a cavity 6. The hollow cylindrical die member 3 is supported by a die case 2. A pair of magnetic field-generating coils 1 are disposed around the core 4 at its upper and lower positions, to apply magnetic fluxes 7 into the cavity 6 through the core 4. The die case 2 has a slurry-injecting aperture, 5 open in the cavity 6.

The axial direction of the slurry-injecting aperture 5 open in the die cavity, into which the slurry is injected under pressure, is preferably deviated from the center O of the center core 5 in the die. With the slurry-injecting aperture 4 having an axial direction deviated from the core center O, the fine powder slurry injected under pressure smoothly and substantially spirally fills up the ring-shaped cavity 6 along the outer circumferential surface of the core 4 or along the inner surface of the die without impinging the die core 4, resulting in a high filling density.

On the other hand, when the axial of the slurry-injecting aperture 5 passes through the center O of the die core, the slurry injected under pressure perpendicularly impinges the die core 4, is divided to right and left flows and converged while impinging at a position opposite to the slurry-injecting aperture 5 by 180°. This generates so-called junctions, resulting cracking in the resultant sintered body.

In the present invention, as shown in FIG. 2, an angle θ (right or acute angle) between the center axis of the slurry-injecting aperture 5 and a radius of the die core 4 (straight line connecting a point A, at which the center axis of the slurry-injecting aperture 5 intersects the die member 3, and the core center O) is 5° to 90°, preferably 10° to 90°, particularly 30° to 90°, though it may be slightly different depending on the size of the die cavity 6.

Though not particularly restrictive, the injection pressure of the slurry into the die cavity 6 is preferably $4.9\times10^4$ Pa to $3.9\times10^6$ Pa (about 0.5-40 kgf/cm$^2$), more preferably $9.8\times1^4$ Pa to $2.9\times10^6$ Pa (about 1-30 kgf/cm$^2$), particularly $2.0\times10^5$ Pa to $1.5\times10^6$ Pa (about 2-15 kgf/cm$^2$).

The intensity of a radially oriented magnetic field applied into the die cavity 6 to orient the fine powder in the slurry is preferably 159 kA/m (about 2 kOe) or more, more preferably 239 kA/m (about 3 kOe) or more. After injecting the slurry under pressure, wet molding is carried out under pressure while maintaining the oriented magnetic field. When the intensity of the oriented magnetic field is less than 159 kA/m (about 2 kOe), the orientation of the fine powder is insufficient, failing to achieve good magnetic properties. During or after injecting the slurry into the die cavity 6 while applying a first oriented magnetic field of 159 kA/m (about 2 kOe) or more, the slurry may be wet-molded under pressure by applying a higher second oriented magnetic field than the first oriented magnetic field. The wet molding of the slurry with improved fluidity under the above conditions can provide a green body having as high a density as 4.0-4.8 g/cm$^3$.

(D) Oil Removal

The resultant green body is heated under a reduced pressure to remove a mineral oil, a synthetic oil or their mixture from the green body. The reduced-pressure heat treatment conditions of the green body are a vacuum degree of 13.3 Pa (about 0.1 Torr) or less, for instance, 6.7 Pa (about $5.0\times10^{-2}$ Torr), and a heating temperature of 100° C. or higher) for instance, about 200° C. The heating time is preferably 1 hour or more, though it may differ depending on the weight and treatment degree of the green body.

(E) Sintering

The sintering of the green body is carried out at a vacuum degree of 0.13 Pa (about 0.001 Torr) or less, preferably $6.7\times10^{-2}$ Pa (about $5.0\times10^{-4}$ Torr) or less, in a range of 1000-1150° C. By this sintering, a sintered body formed from a slurry of fine powder pulverized in an atmosphere having an oxygen content of substantially 0% has a density of 7.52-7.85 g/cm$^3$, and a sintered body formed from a slurry of fine powder pulverized in an atmosphere having an oxygen content of 0.005-0.5% has a density of 7.42-7.75 g/cm$^3$. In both cases, because the oxidation of the fine powder and the green body is prevented by the effect of a mineral oil, a synthetic oil or their mixture shielding the fine powder from the air, the content of O of the former sintered body is 0.05-0.25% by mass, and the content of O of the latter sintered body is more than 0.25% and 0.60% or less by mass.

As described above, by injecting a slurry with improved fluidity under pressure substantially spirally and smoothly into a ring-shaped die cavity in a radially oriented magnetic field, a high filling ratio and thus a high green body density can be obtained, thereby making it possible to prevent the cracking, chipping, deformation, etc. of the green body and the sintered body. It is thus possible to provide a radially oriented ring-shaped sintered permanent magnet having a size of an outer diameter of 10-1.00 mm, an inner diameter 8-96 mm, and a height of 10-70 mm. The present invention is particularly suitable for the production of small ring magnets having outer diameters of 10-30 mm, inner diameters 8-28 mm, and heights of 10-50 mm.

Because the smooth filling of the slurry is conducted in an oriented magnetic field, it is possible to provide a green body having a high and uniform density and thus a ring magnet with a uniform distribution of a surface magnetic flux density in its axial direction. When the variation of a surface magnetic flux density is 7.5% or less in the axial direction of the ring magnet, a cogging torque (particularly higher cogging torque) can be sufficiently suppressed when the ring magnet is used in a motor. When the variation of a surface magnetic flux density is 5% or less, particularly 3% or less, extremely silent motors without energy loss can be obtained.

The present invention will be specifically described below with reference to Examples without intention of restricting the scope of the present invention. Incidentally, the magnetic properties were measured at room temperature (25° C.), and the average diameter of powder was measured by an air permeation method.

EXAMPLE 1

An ingot having a composition by mass of 17.6% of Nd, 7.9% of Pr, 5% of Dy, 1.1% of B, 0.08% of Al, 1.5% of Co, 0.1% of Cu, 0.01% of P, 0.01% of O, 0.004% of C, and 0.006% of N, the balance being Fe, was produced. This ingot was pulverized to forim coarse powder having a particle size of 20-500 μm. The composition analysis indicated that this coarse powder had a composition by mass of 17.5% of Nd, 7.7% of Pr, 5% of Dy, 1.1% of B, 0.08% of Al, 1.5% of Co, 0.1% of Cu, 0.01% of P, 0.15% of O, 0.015%. of C, and 0.006% of N, the balance being Fe.

After 1.00 kg of this coarse powder was charged into a jet nill, an atmosphere in the jet nll was substituted with an Ar gas, such that an oxygen concentration in the atmosphere was substantially 0%. Next, a nitrogen gas was introduced such that the concentration of a nitrogen gas in an Ar gas was 0.005%. In this atmosphere, the coarse powder was finely pulverized at a pressure of $6.9\times10^5$ Pa (about 7.0 kgf/cm$^2$) and at a coarse powder supply rate of 12 kg/hr. A container filled with a mineral oil was disposed at a fine powder-recovering outlet of the jet mnill, to recover the resultant fine powder directly in the mineral oil in an Ar gas atmosphere. The resultant fine powder had an average diameter of 4.5 μm. By adjusting the amount of the mineral oil, the concentration of the fine powder in the resultant slurry was controlled to 75% by mass.

This slurry was wet-molded in a die cavity under a pressure of $4.9\times10^7$ Pa (about 0.5 ton/cm$^2$), while applying an oriented magnetic field of 796 kA/m (about 10 kOe). The direction of-the oriented magnetic field applied was perpendicular to the molding direction. The resultant green body was heated at 80° C. in vacuum of 5.3 Pa (about $4.0\times10^{-2}$ Torr) for 2 hours to remove the mineral oil, and then sintered at 1065° C. in vacuum of $6.7\times10^{-3}$ Pa (about $5.0\times10^{-5}$ Torr) for 4 hours. The composition of the resultant sintered body was, by mass, 17.5% of Nd, 7.7% of Pr, 5% of Dy, 1.1% of B, 0.08% of Al, 1.5% of Co, 0.1% of Cu, 0.0.100% of P, 0.017% of O, 0.070% of C, and 0.045% of N, the balance being Fe. This sintered body was heat-treated at 480° C. for 2 hours in an Ar gas atmosphere. As shown in Table 1, the measurement of the magnetic properties of the sintered magnet after machining indicated that it had good -magnetic properties.

COMPARATIVE EXAMPLE 1

Coarse powder was produced from an ingot having the same composition as in Example 1 except for containing no P in the same manner as in Example 1. The composition of this coarse powder was the same as in Example 1 except for containing no P and 0.14% by mass of O. This coarse powder was finely pulverized in the same manner as in Example 1. The resultant fine powder had an average diameter of 4.5 μm. The composition analysis of a sintered body formed from this fine powder in the same manner as in Example 1 indicated that the sintered body had a composition by mass of 17.5% of Nd, 7.7% of Pr, 5% of Dy, 1.1% of B, 0.08% of Al, 1.5% of Co, 0.1% of Cu, 0.16% of O, 0.070% of C, and 0.045%. of N, the balance being Fe. This sintered body was machined to measure its magnetic properties. The results are shown in Table 1. Table 1 indicates that the coercivity iHc of the sintered body was lower in Comparative Example 1 than in Example 1.

EXAMPLE 2

An ingot having a composition by mass of 19.8% of Nd, 8.9% of Pr, 1.3% of Dy, 1.1% of B, 0.10% of Al, 2.5% of Co, 0.2% of Nb, 0.08% of Ga, 0.01% of O, 0.003% of C, and 0.005% of N, the balance being Fe, was produced. This ingot was pulverized to form coarse powder having a particle size of 20-500 μm. The composition analysis indicated that this coarse powder had a composition by mass of 19.7% of Nd, 8.8% of Pr, 1.3% of Dy, 1.1% of B, 0.10% of Al, 2.5% of Co, 0.2% of Nb, 0.08% of Ga, 0.12% of O, 0.013% of C, and 0.007% of N, the balance being Fe.

100 kg of this coarse powder was mixed with 454 g of a 5-%-by-mass aqueous solution of sodium hypophosphite in pure water, and dried in vacuum. The composition analysis of the dried coarse powder indicated that it had a composition by mass of 19.7% of Nd, 8.8% of Pr, 1.3% of Dy, 1.1% of B, 0.10% of Al, 2.5% of Co, 0.2% of Nb, 0.08% of Ga, 0.008% of P, 0.16% of O, 0.013% of C, and 0.009% of N, the balance being Fe. This coarse powder was finely pulverized in the same manner as in Example 1. The resultant fine powder had an average diameter of 4.7 μm. The composition analysis of a sintered body formed from this fine powder in the same manner as in Example 1 indicated that it had a composition by mass of 19.7% of Nd, 8.8% of Pr, 1.3% of Dy, 1.1% of B, 0.10% of Al, 2.5% of Co, 0.2% of Nb, 0.08% of Ga, 0.008% of P, 0.18% of O, 0.067% of C, and 0.055% of N. the balance being Fe. This sintered body was machined to measure its magnetic properties, which were good as shown in Table 1.

COMPARATIVE EXAMPLES 2

100 kg of the same coarse powder as in Example 2 was finely pulverized in the same manner as in Example 1 except for adding no aqueous solution of sodium hypophosphite. The resultant fine powder had an average diameter of 4.7 μm. The composition analysis of a sintered body formed from this fine powder in the same manner as in Example 1 indicated that it had a composition by mass of 19.7% of Nd, 8.8% of Pr, 1.3% of Dy, 1.1% of B, 0.10% of Al, 2.5% of Co, 0.2% of Nb, 0.08% of Ga, 0.16% of O, 0.067% of C, and 0.050% of N, the balance being Fe. This sintered body was machined to measure its magnetic properties. The coercivity iHc of this sintered body was lower than that of Example 2 as shown in Table 1.

TABLE 1

| | Composition (% by mass) | | | | |
|---|---|---|---|---|---|
| No. | Nd, Pr, Dy | P | O | C | N |
| Example 1 | 30.2 | 0.010 | 0.17 | 0.070 | 0.045 |
| Comparative Example 1 | 30.2 | — | 0.16 | 0.070 | 0.045 |
| Example 2 | 29.8 | 0.008 | 0.18 | 0.067 | 0.055 |
| Comparative Example 2 | 29.8 | — | 0.16 | 0.067 | 0.050 |

| | Magnetic Properties | | | | | |
|---|---|---|---|---|---|---|
| | Br | | iHc | | (BH)max | |
| No. | kG | T | kOe | kA/m | MGOe | kJ/m$^3$ |
| Example 1 | 13.5 | 1.35 | 23.5 | 1.87 | 43.9 | 347 |
| Comparative Example 1 | 13.5 | 1.35 | 21.7 | 1.73 | 43.8 | 348 |
| Example 2 | 14.5 | 1.45 | 16.2 | 1.29 | 50.8 | 403 |
| Comparative Example 2 | 14.5 | 1.45 | 15.0 | 1.19 | 50.6 | 402 |

EXAMPLE 3

Coarse powder for an R—Fe—B permanent magnet having a composition by mass of 19.85% of Nd, 8.95% of Pr, 1.00% of Dy, 1.02% of B, 0.10% of Al, 2.00% of Co, 0.10% ofCu, 0.15% of O, 0.04% of C, and 0.02% of N, the balance being Fe, was charged into a jet mill. After replacing an atmosphere in. the jet mill with a nitrogen gas, the coarse powder was finely pulverized at a pressure of $6.9\times10^5$ Pa (7.0 kgf/cm$^2$) and at a coarse powder supply rate of 15 kg/hr. The resultant fine powder was directly recovered in a nuneral oil ("Super Sol PA30," available from Idemitsu Kosan Co., Ltd.) disposed at an outlet of the jet mill without contact with the air, to form a slurry.

This mineral oil was mixed with a 5-%-by-mass solution of sodium hypophosphite in glycerin in advance, such that the ratio of sodium hypophosphite to the mineral oil was 0.1% by mass. A mass ratio of the mineral oil to the fine powder in the slurry was 1:3. The resultant fine powder had an average diameter of 4.5 μm. The slurry thus produced was injected under pressure into a cavity of a die provided with coils for generating an oriented magnetic field as shown in FIG. 2, to carry out molding.

An angle θ between the axial direction of the slurry-injecting aperture 5 and a radial direction of the die core 4 was 30°. The intensity of a radially oriented magnetic field applied to the cavity was 239 kA/m (3 kOe), and the slurry injection pressure was $3.9\times10^5$ Pa (4 kgf/cm$^2$). After injecting the slurry, wet molding was conducted under a pressure of $7.8\times10^7$ Pa (0.8 ton/cm$^2$) in an oriented magnetic field whose intensity was maintained at 239 kA/m (3 kOe), to form a green body having an outer diameter of 24.5 mm, an inner diameter of 17.4 mm and a height of 30.0 mm. The density of the green body was 4.30 g/cm$^3$.

This green body was subjected to an oil-removing treatment at 200° C. under a reduced pressure of 6.7 Pa ($5\times10^{-2}$ Torr) for 2 hours, and then sintered at 1050° C. under a reduced pressure of $2.7\times10^{-2}$ Pa ($2\times10^{-4}$ Torr) for 3 hours. The resultant sintered body had a size of an outer diameter of 20.0 mm, an inner diameter of 15.0 mm and a height of 26.0 mm, and a density of 7.58 g/cm$^3$. After heat treatment at 500° C. for 2 hours, the sintered body was finished by machining to a size of an outer diameter of 19.6 mm, an inner diameter of 15.4 mm and a height of 25.0 mm. After forming four magnetic poles by magnetization, the surface magnetic flux density of the sintered body was measured. As a result, high peak values were observed as shown in Tables 2 and 3.

Figure 3A:
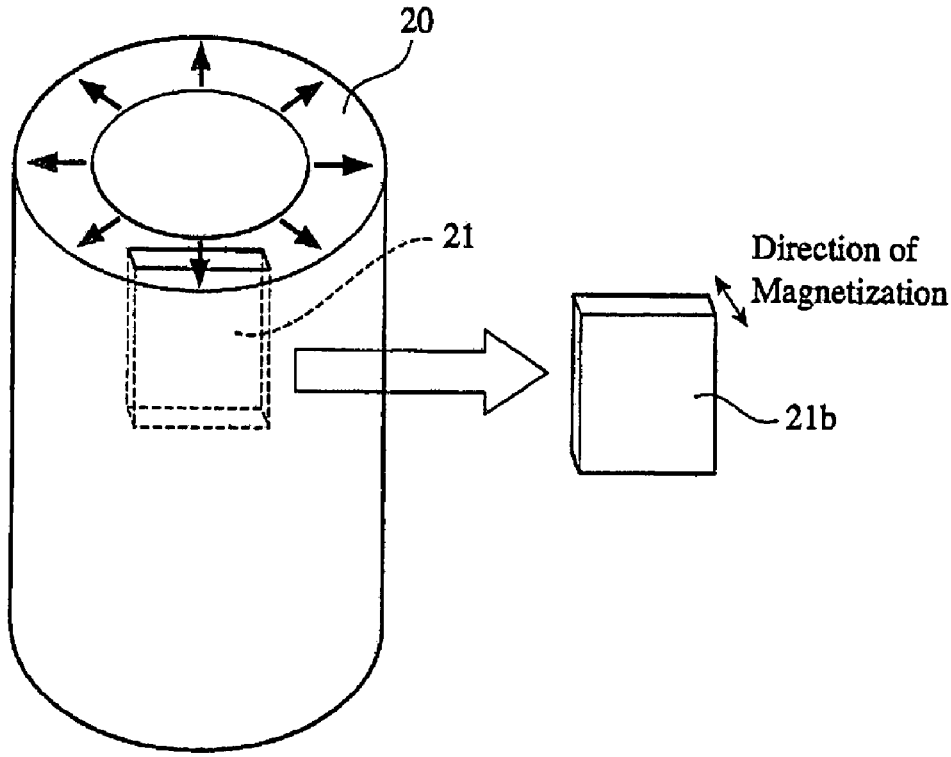
FIG. 3(*a*) is a schematic perspective view showing a test piece cut out from a ring-shaped sintered body.
Figure 3B:
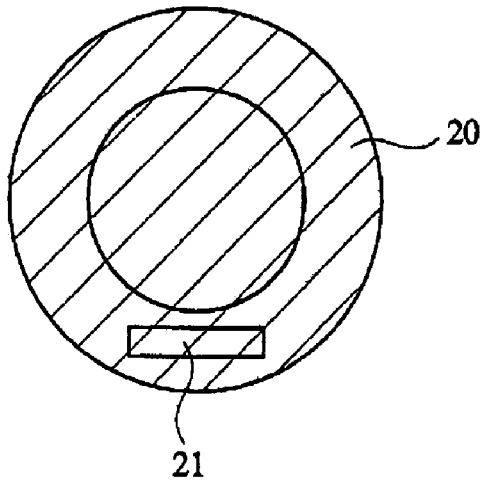
Figure 4:
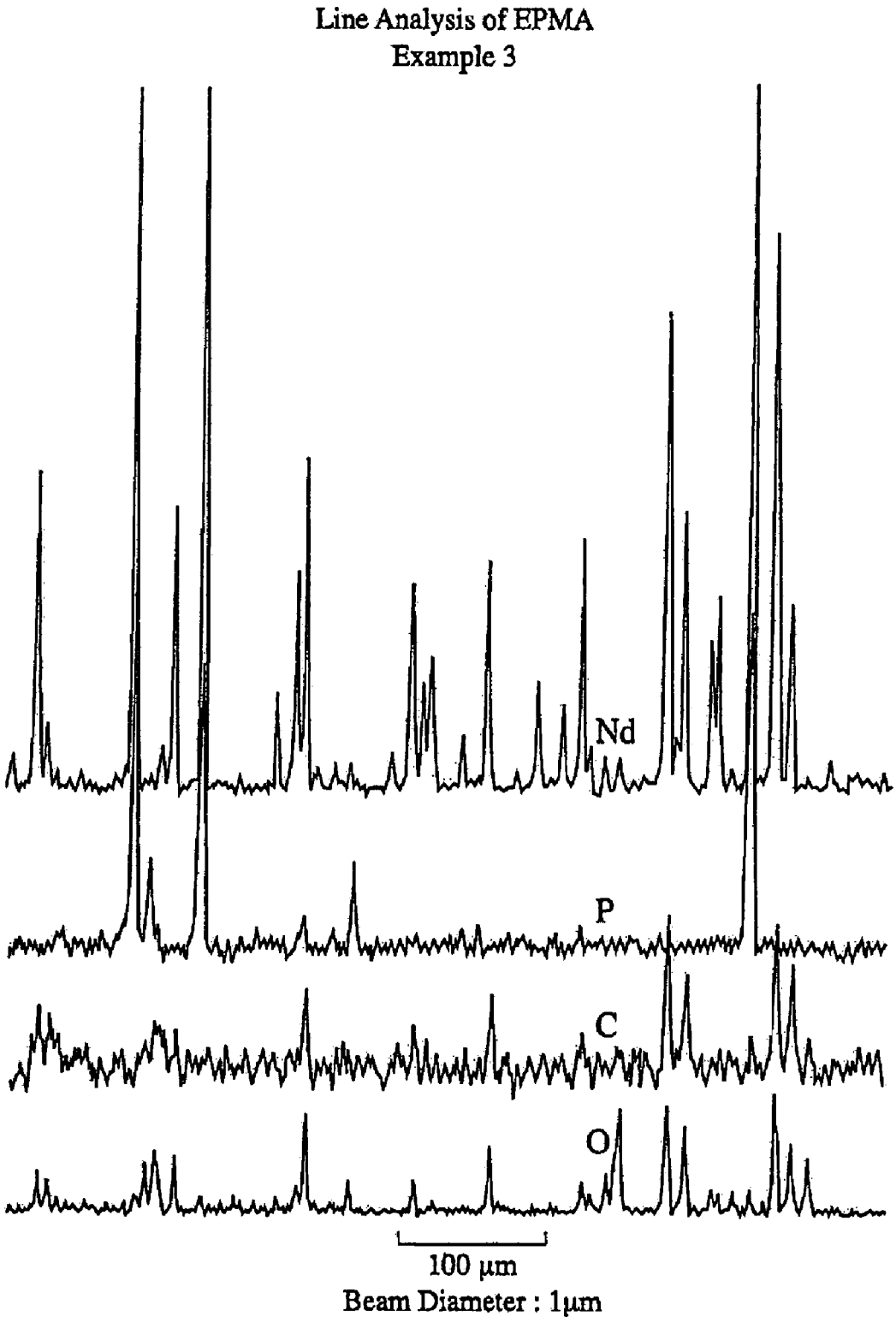
FIG. 4 is a graph showing the line analysis results of EPMA in the sintered body of Example 3.

A test piece 21*b* of 35 mm×7 mm×1 mm (1-mm thickness direction aligned with a magnetization direction) was cut out from the sintered body 20 as shown in FIG. 3. Incidentally, the reference numeral 21 denotes a test piece before cutting. The measurement of the magnetic properties of eight test pieces 21*b* stacked in a thickness direction indicated that the test piece had high magnetic properties as shown in Tables 2 and 3. The composition analysis of this sintered body indicated that it had a composition by mass of 19.85% of Nd, 8.95% of Pr, 1.00% of Dy, 1.02% of B, 0.10% of Al, 2.00% of Co, 0.10% of Cu, 0.17% of O, 0.06% of C, 0.05% of N. and 0.01% of P, the balance being Fe. As a result of the line analysis of EPMA of the test piece 21*b*, the peaks of P were observed as shown in FIG. 4. It is clear from FIG. 4 that P existed mainly in a rare earth-rich phase of crystal grain boundaries.

EXAMPLE 4

The same coarse powder as in Example 3 was finely pulverized in the same manner as in Example 3 and recovered in a mineral oil ("Super Sol PA30," available from Idemitsu Kosan Co., Ltd.) to formn a slurry. The mass ratio of the mineral oil to thefine powder was 1:3. The resultant fine powder had an average diameter of 4.8 μm. This slurry was mixed with a 10-%-by-mass solution of sodium hypophosphite in ethanol, such that the ratio of sodium hypophosphite to the mineral oil was 0.3% by mass.

The resultant slurry was injected under pressure into a die cavity, in which an angle θ between the axis of a slurry-injecting aperture and a radius of a die core was 5°, and wet-molded in a magnetic field in the same manner as in Example 3, to obtain a green body of an outer diameter of 24.5 mm, an inner diameter of 17.4 mm and a height of 30.0 mm. The density of the green body was 4.40 g/cm$^3$.

This green body was subjected to oil removal and sintering in the same manner as in Example 3, to obtain a sintered body of an outer diameter of 20.1 mm, an inner diameter of 14.9 mm and a height of 26.2 mm. The density of the sintered body was 7.56 g/cm$^3$. This sintered body was heat-treated at 500° C. for 2 hours. This sintered body was finished by machining to a size of an outer diameter of 19.6 mm, an inner diameter of 15.4 mm and a height of 25.0 mm, and magnetized to have four magnetic poles in the same manner as in Example 3. The surface magnetic flux density of the sintered body was measured. As a result, high peak values were observed as shown in Tables 2 and 3.

Figure 5:
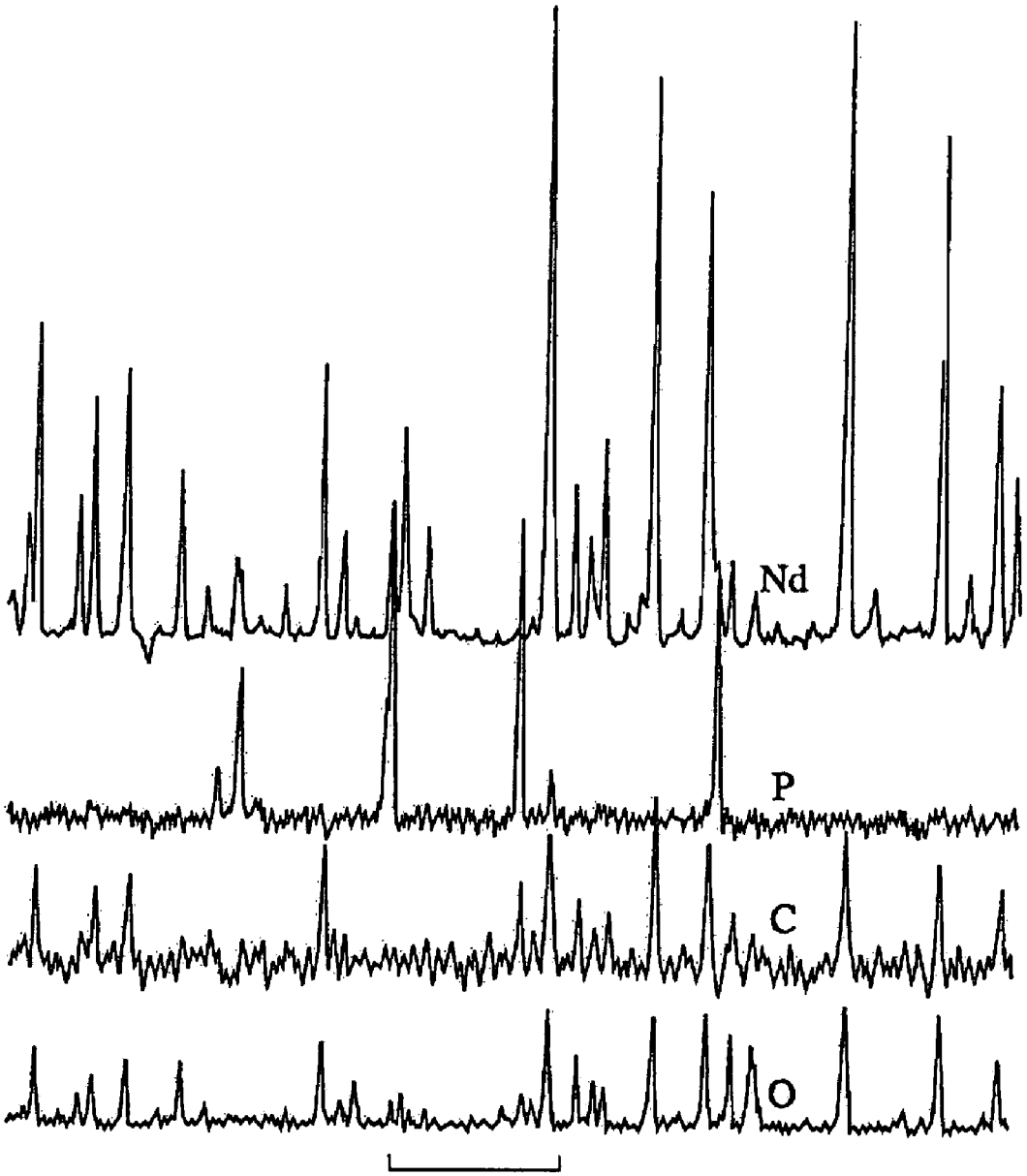
FIG. 5 is a graph showing the line analysis results of EPMA in the sintered body of Example 4.

A test piece 21*b* was cut out from this sintered body as shown in FIG. 3. The position of cutting the test piece 21*b* and the conditions of measuring its size and magnetic properties were the same as in Example 3. Good magnetic properties as shown in Tables 2 and 3 were appreciated. The composition analysis of the sintered body indicated that it had a composition by mass of 19.85% of Nd, 8.95% of Pr, 1.00% of Dy, 1.02% of B, 0.10% of Al, 2.00% of Co, 0.10% of Cu, 0.16% of O, 0.06% of C, 0.04% of N, and 0.03% of P, the balance being Fe. As a result of the line analysis of EPMA of the test piece 21*b,* the peaks of P were appreciated as shown in FIG. 5.

EXAMPLE 5

The slurry produced in Example 3 was injected under pressure into a die cavity, to which a radially oriented magnetic field of 239 kA/m (3 kOe) was applied, and wet-molded in a magnetic field in the same manner as in Example 3. The slurry injection pressure was $3.9\times10^5$ Pa (4 kgf/cm$^2$). The intensity of the oriented magnetic field was increased to 398 kA/m (5 kOe) after 0.5 seconds from the start of slurry injection, and wet molding was conducted while keeping this intensity of the magnetic field after the completion of slurry injection, to obtain a green body of an outer diameter of 24.5 mm, an inner diameter of 17.4 mm and a height of 30.0 mm. The density of the green body was 4.25 g/cm$^3$.

This green body was subjected to oil removal and sintering in the same manner as in Example 3, to obtain a sintered body of an outer diameter of 19.9 mm, an inner diameter of 15.1 mm and a height of 26.1 mm. The density of the sintered body was 7.59 g/cm$^3$. This sintered body was heat-treated in the same manner as in Example 3, and machined to a size of an outer diameter of 19.6 mm, an inner diameter of 15.4 mm and a height of 25.0 mm The resultant product was magnetized to have four magnetic poles, and its surface magnetic flux density was measured in the axial direction of a magnetic pole. Tables 2 and 3 show that it had a good surface magnetic flux density. The measurement of the magnetic properties of a test piece cut out in the same manner as in Example 3 indicated that it had high magnetic properties as shown in Tables 2 and 3.

EXAMPLE 6

The slurry produced in Example 3 was injected under pressure into a die cavity, in which an angle θ between the axis of the slurry-injecting aperture and the radius of the die core was 45°, and wet-molded in a magnetic field in the same manner as in Example 3. in this Example, the die was changed to one for a large-diameter ring magnet. The intensity of a radially oriented magnetic field applied to the cavity was 478 kA/m (about 6 kOe), and the injection pressure was $5.9\times10^5$ Pa (about 6 kgf/cm$^2$). After injecting the slurry, wet molding was conducted under a pressure of $4.9\times10^7$ Pa (0.5 ton/cm$^2$) in an oriented magnetic field whose intensity was maintained at 478 kA/m (about 6 kOe), to obtain a green body of an outer diameter of 114.0 mm, an inner diameter of 95.0 mm and a height of 20.5 mm. The density of the green body was 4.28 g/cm$^3$.

This green body was subjected to oil removal and sintering in the same manner as in Example 3, to obtain a sintered body of an outer diameter of 92.5 mm, an inner diameter of 81.5 mm and a height of 18 mm. The density of the sintered body was 7.57 g/cm$^3$ The sintered body was heat-treated at 500° C. for 2 hours. This sintered body was finished by machining to a size of an outer diameter of 91.5 mm, an inner diameter of 80.5 mm and a height of 16 mm. The sintered body was magnetized to have 16 magnetic poles, and measured with respect to a surface magnetic flux density in the axial direction of a magnetic pole. As a result, it was confirmed that it had a good surface magnetic flux density as shown in Tables 2 and 3. Four test pieces of 5 mm×10 mm×2 mm cut out from the sintered body were stacked in a thickness direction to measure their magnetic properties. As a result, it was confirmed that they had high magnetic properties as shown in Tables 2 and 3.

EXAMPLE 7

The slurry produced in Example 3 was injected under pressure into a die cavity, in which an angle θ between the axis of the slurry-injecting aperture and the radius of the die core was 15°, and wet-molded in a magnetic field in the same manner as in Example 3. In this Example, the die was changed to one for a riddle-diameter, long ring magnet. The intensity of a radially oriented magnetic field applied to the cavity was 199 kA/m (about 2.5 kOe), and the injection pressure was $2.0\times10^5$ Pa (about 2 kgf/cm$^2$). After injecting the slurry, the intensity of the oriented magnetic field was increased to 637 kA/m (8 kOe), and wet molding was conducted under a pressure of $3.9\times10^7$ Pa (0.4 ton/cm$^2$) in a magnetic field with intensity maintained at the above level, to obtain a green body of an outer diameter of 50 mm, an inner diameter of 40 mm and a height of 76 mm. The density of the green body was 4.15 g/cm$^3$.

This green body was subjected to oil removal and sintering in the same manner as in Example 3, to obtain a sintered body of:an outer diameter of 40.4 mm, an inner diameter of 35.0 mm and a height of 65.2 mm. The density of the sintered body was 7.59 g/cm$^3$. The sintered body was heat-treated at 500° C. for 2 hours. This sintered body was finished by machining to a size of an outer diameter of 40.0 mm, an inner diameter of 35.4 mm and a height of 64.2 mm. The sintered body was magnetized to have 8 magnetic poles, and its surface magnetic flux density was measured in the axial direction of a magnetic pole. As a result, it was confirmed that it had good surface magnetic flux density as shown in Tables 2 and 3. Eight test pieces of 5 mm×8 mm×1 mm cut out from the sintered body were stacked in a thickness direction to measure their magnetic properties. As a result, it was confirmed that they had high magnetic properties as shown in Tables 2 and 3.

COMPARATIVE EXAMPLE 3

The same coarse powder as in Example 3 was finely pulverized in the same manner as in Example 3, and the resultant fine powder was recovered in a mineral oil ("Super Sol PA30," available from Idemitsu Kosan Co., Ltd.) to form a slurry. The mass ratio of the mineral oil to the fine powder was 1:3. The average diameter of the fine powder was 4.5 μm. The mineral oil was mixed with a 5-%-by-mass solution of sodium hypophosphite in glycerin in advance, such that the ratio of sodium hypophosphite to the mineral oil was 1% by mass. The resultant slurry was injected under pressure into a die cavity and wet-molded in a magnetic field in the same manner as in Example 3, to obtain a green body of an outer diameter of 24.5 mm, an inner diameter of 17.4 mm and a height of 30.0 mm The density of the green body was 4.35 g/cm$^3$.

This green body was subjected to oil removal and sintering in the same manner as in Example 3, to obtain a sintered body of an outer diameter of 20.2 mm, an inner diameter of 15.1 mm and a height of 25.9 mm. The density of the sintered body was 7.58 g/cm$^3$. The sintered body was heat-treated at 500° C. for 2 hours. Though it was tried to machine this sintered body, the sintered body was broken by a load during working because of its low mechanical strength, resulting in failure to evaluation. Eight test pieces of 5 mm×7 mm×1 mm cut out from a broken piece of the sintered body was stacked in a thickness direction to measure their magnetic properties. The results are shown in Tables 2 and 3. The composition analysis of the sintered body indicated that it had a composition by mass of 19.85% of Nd, 8.95% of Pr, 1.00% of Dy, 1.02% of B, 0.10% of Al, 2.00% of Co, 0.10% of Cu, 0.16% of O, 0.07% of C, 0.04% of N, and 0.09% of P, the balance being Fe.

COMPARATIVE EXAMPLE 4

The same coarse powder as in Example 3 was finely pulverized in the same manner as in Example 3, and the resultant fine powder was recovered in a mineral oil ("Super Sol PA30," available from Idemitsu Kosan Co., Ltd.) to form a slurry. The mass ratio of the mineral oil to the fine powder was 1:3. The average diameter of the fine powder was 4.5 μm. No fluidity-improving agent (a solution of sodium hypophosphite in glycerin or ethanol) was added to any of the mineral oil and the slurry. This slurry was injected under pressure into a die cavity and wet-molded in a magnetic field in the same manner as in Example 3. However, because the slurry had poor fluidity at the time of injection under pressure, resulting in a low filling ratio into the die cavity, the resultant green body had a size of an outer diameter of 24.5 mm, an inner diameter of 17.4 mm and a height of 26.5 mm. The density of the green body was 3.80 g/cm$^3$.

Figure 6:
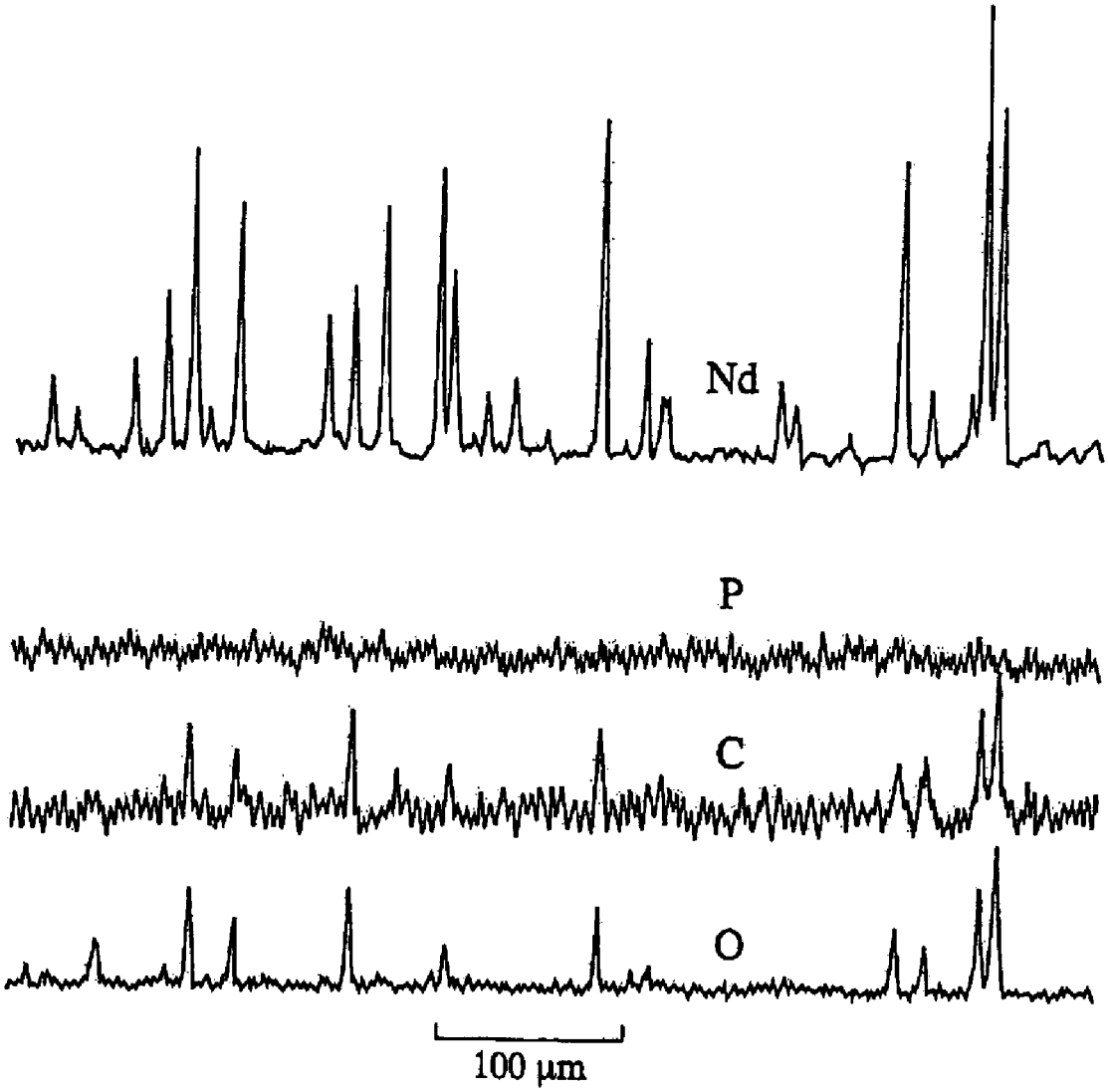
FIG. 6 is a graph showing the line analysis results of EPMA in the sintered body of Comparative Example 4.

This green body was subjected to oil removal and sintering in the same manner as in Example 3, to obtain a sintered body of an outer diameter of 19.7 mm, an inner diameter of 14.8 mm and a height of 23.3 mm. The density of the sintered body was 7.57 g/cm$^3$. Because of a poor filling ratio of the slurry on the side of an upper punch, the sintered body was deformed to an elliptical shape on the side of the upper punch. Because of the deformation, the sintered body could not be machined to a desired product size. The sintered body was heat-treated at 500° C. for 2 hours, and a test piece of 5 mm×7 mm×1 mm was cut out from a deformation-free portion of the sintered body. Eight test pieces were stacked in a thickness direction to measure their magnetic properties. The results are shown in Tables 2 and 3. The composition analysis of the sintered body indicated that it had a composition by mass of 19.85% of Nd, 8.95% of Pr, 1.00% of Dy, 1.02% of B, 0.10% of Al, 2.00% of Co, 0.10% of Cu, 0.16% of O, 0.07% of C, and 0.06% of N, the balance being Fe. The line analysis of EPMA of this sintered body indicated that there were no peaks of P as shown in FIG. 6, unlike the sintered bodies of Examples 3 and 4.

COMPARATIVE EXAMPLE 5

The slurry produced in Example 3 was injected under pressure into a die cavity, in which the axial direction of a slurry-injecting aperture was aligned with a radial direction of the die core (θ=0°), and wet-molded in a magnetic field in the same manner as in Example 3, to obtain a green body of an outer diameter of 24.5 mm an inner diameter of 17.4 mm and a height of 30.0 mm. The density of the green body was 4.29 g/cm$^3$. This green body was subjected to oil removal and sintering in the same manner as in Example 3, to obtain a sintered body of an outer diameter of 20.1 mm, an inner diameter of 15.1 mm and a height of 25.9 mm. The density of the sintered body was 7.60 g/cm$^3$. The resultant sintered body had longitudinal cracks at a position opposite to the injection aperture by 180°. Because of the cracks, this sintered body could not be machined to a desired size. Eight test pieces of 5 mm×7 mm×1 mm cut out from a cracks-free portion of the sintered body were stacked in a thickness direction to measure their magnetic properties. The results are shown in Tables 2 and 3.

COMPARATIVE EXAMPLE 6

The slurry produced in Example 3 was injected under pressure into a die cavity, and wet-molded in an oriented magnetic field of 79.6 kA/ (1.0 kOe) in the same manner as in Example 3, to obtain a green body of an outer diameter of 24.5 mm, an inner diameter of 17.4 mm and a height of 30.0 mm. The density of the green body was 4.32 g/cm$^3$. This green body was subjected to oil removal and sintering in the same manner as in Example 3, to obtain a sintered body of an outer diameter of 20.3 mm, an inner diameter of 15.2 mm and a height of 25.8 mm. The density of the sintered body was 7.59 g/cm$^3$. This sintered body was heat-treated at 500° C. for 2 hours.

This sintered body was finished by machining to a size of an outer diameter of 19.6 mm, an inner diameter of 15.4 mm and a height of 25.0 mm. After forming four magnetic poles by magnetization, the surface magnetic flux density was measured. As a result, the peak value Was lower than Example 3 as shown in Tables 2 and 3. Eight test pieces of 5 mm×7 mm×1 mm cut out from the sintered body were stacked in a thickness direction to measure their magnetic properties. As a result, it was confined that the magnetic properties were lower than those of Example 3 as shown in Tables 2 and 3.

EXAMPLE 8

Coarse powder for an R—Fe—B permanent magnet having a composition by mass of 22.00% of Nd, 5.50% of Pr, 5.00% of Dy, 1.03% of B, 0.08% of Al, 1.00% of Co, 0.12% of Cu, 0.10% of Ga, 0.09% of O, 0.03% of C, and 0.015% of N, the balance being Fe, was charged into a jet mill. After replacing an atmosphere in the jet mill with a nitrogen gas, the coarse powder was finely pulverized at pressure of $6.4\times10^5$ Pa (6.5 kgf/cm$^2$) and at a coarse powder supply rate of 20 kg/hr. During pulverization, a trace amount of oxygen was introduced into a jet mill to control the oxygen concentration in the nitrogen gas to 0.080-0.120%. The resultant fine powder had a particle size of 5.0 μm. The composition of the fine powder was, by mass, 22.00% of Nd, 5.50% of Pr, 5.00% of Dy, 1.03% of B, 0.08% of Al, 1.00% of Co, 0.12% of Cu, 0.10% of Ga, 0.48% of O, 0.06% of C, and 0.015% of N, the balance being Fe.

This fine powder was mixed with a mineral oil ("Super Sol PA30," available from Idemitsu Kosah Co., Ltd.) to form a slury. The mineral oil contained a 5-%-by-mass solution of sodium hypophosphite in glycerin, such that the ratio of sodium hypophosphite to the minneral oil 0.2% by mass. The mass ratio of the fine powder to the mineral oil was 1:3. The resultant slurry was injected under pressure into a ring-shaped die cavity, to which a radially oriented magnetic field was applied, and wet-molded in the same manner as in Example 3, to obtain a green body of an outer diameter of 24.5 mm, an inner diameter of 17.4 mm; and a height of 30.0 mm. The density of the green body was 4.45 g/cm$^3$.

This green body was sintered at 1070° C. under a reduced pressure of 6.7 Pa ($5\times10^{-5}$Torr) for 3 hours, to obtain a sintered body of an outer diameter of 20.3 mm, an inner diameter of 15.1 mm and a height of 25.8 mm. The density of the sintered body was 7.61 g/cm$^3$. The sintered body was heat-treated at 550° C. for 2 hours. This sintered body was machined to a size of an outer diameter of 19.6 mm, an inner diameter of 15.4 mm and a height of 25.0 mm, and magnetized to have 8 magnetic poles. The measurement results of a surface magnetic flux density are shown in Tables 2 and 3. Magnetic properties were measured on a test piece having the same size as in Example 3 cut out from the sintered body. As a result, it was confirmed that it had good magnetic properties as shown in Tables 2 and 3. The composition analysis of the sintered body indicated that it had a composition by mass of 22.00% of Nd, 5.50% of Pr, 5.00% of Dy, 1.03% of B, 0.08% of Al, 1.00% of Co, 0.12% of Cu, 0.10% of Ga, 0.46% of O, 0.06% of C, 0.015% of N, and 0.02% of P, the balance being Fe.

COMPARATIVE EXAMPLE 7

Dry fine powder produced in Example 8 was filled in the same die cavity as in Example 8 without mixing with a mineral oil, and molded in an oriented magnetic field of 239 kA/m (3 kOe) under a reduced pressure of $7.8\times10^7$ Pa (0.8 ton/cm$^2$), to produce a green body of an outer diameter of 24.5 mm, an inner diameter of 17.4 mm and aheight of 30.0 mm. The density of the green body was 3.78 g/cm$^3$. This green body was sintered at 1070° C. under a reduced pressure of 2.7 Pa ($2\times10^{-5}$ Torr) for 3 hours, to obtain a sintered body of an outer diameter of 20.1 mm, an inner diameter of 15.0 mm and a height of 25.9 mm. The density of the sintered body was 7.59 g/cm$^3$. This sintered body was heat-treated at 550° C. for 2 hours, and then machined to a size of an outer diameter of 19.6 mm, an inner diameter of 15.4 mm and a height of 25.0 mm. This sintered body was magnetized to have 8 magnetic poles, and its surface magnetic flux density was measured in the axial direction of a magnetic pole. As a result it was confirmed that it had a lower surface magnetic flux density than that of Example 8 as shown in Tables 2 and 3. Eight test-pieces of 5 mm×7 mm×1 mm cut out from the sintered body were stacked in a thickness direction to measure their magnetic properties. As a result, it was confirmed that they had lower magnetic properties than those of Example 8 as shown in Tables 2 and 3.

COMPARATIVE EXAMPLE 8

Dry fine powder produced in Example 8 was charged into the die cavity of Example 8 from above without mixing with a mineral oil, and molded under a pressure of $7.8\times10^7$ Pa (0.8 ton/cm$^2$) in an oriented magnetic field of 318 kA/m (4 kOe) to produce a first green body of an outer diameter of 24.5 mm, an inner diameter of 17.4 mm and a height of 10.0 mm. With a lower punch lowered, dry fine powder was again charged into the die cavity such that it was accumulated on the first green body, and a second green body of an outer diameter of 24.5 mm, an inner diameter of 17.4 mm and a height of 10.0 mm, which had the same volume as that of the first green body, was produced under a pressure of $7.8\times10^7$ Pa (0.8 ton/cm$^2$) integrally with the first green body. Further, the third filling and molding were conducted by the same method to integrally produce a third green body of the same volume. The resultant integral green body had a size of an outer diameter of 24.5 mm, an inner diameter of 17.4 mm and a height of 30.0 mm. The density of the integral green body was 3.74 g/cm$^3$.

This integral green body was sintered at 1070° C. under a reduced pressure of 6.7 Pa ($5.0\times10^{-5}$ Torr) for 3 hours, to obtain a sintered body of an outer diameter of 20.0 mm, an inner diameter of 14.9 mm and a height of 26.1 mm. The density of the sintered body was 7.58 g/cm$^3$. The sintered body was heat-treated at 550° C. for 2 hours, and machined to a size of an outer diameter of 19.6 mm, an inner diameter of 15.4 mm and a height of 25.0 mm. This sintered body was magnetized to have 8 magnetic poles, and its surface magnetic flux density was measured in the axial direction of a magnetic pole. As a result, it was confirmed that the surface magnetic flux density of this Example was higher than that of Comparative Example 7 but lower than that of Example 8 as shown in Tables 2 and 3. Eight test pieces of 5 mm×7 mm×1 mm cut out from the sintered body were stacked in a thickness direction to measure their magnetic properties. As a result, it was confirmed that the magnetic properties of this Example were higher than those of Comparative Example 7 but lower than those of Example 8 as shown in Tables 2 and 3. In addition, the sintered body had a surface magnetic flux density locally low at three-piece molding junctions, so that it exhibited poorer cogging characteristics than those of Example 8 when assembled in a motor.

TABLE 2

| | Green Body | | Size of Sintered Body(1) (mm) | |
|---|---|---|---|---|
| No. | Size (mm)(1) | Density (g/cm$^3$) | Before Working | After Working |
| Example 3 | 24.5 × 17.4 × 30.0 | 4.30 | 20.0 × 15.0 × 26.0 | 19.6 × 15.4 × 25.0 |
| Example 4 | 24.5 × 17.4 × 30.0 | 4.40 | 20.1 × 14.9 × 26.2 | 19.6 × 15.4 × 25.0 |
| Example 5 | 24.5 × 17.4 × 30.0 | 4.25 | 19.9 × 15.1 × 26.1 | 19.6 × 15.4 × 25.0 |
| Example 6 | 114.0 × 95.0 × 20.5 | 4.28 | 92.5 × 81.5 × 18.0 | 91.5 × 80.5 × 16.0 |
| Example 7 | 50.0 × 40.0 × 76.0 | 4.15 | 40.4 × 35.0 × 65.2 | 40.0 × 35.4 × 64.2 |
| Example 8 | 24.5 × 17.4 × 30.0 | 4.45 | 20.3 × 15.1 × 25.8 | 19.6 × 15.4 × 25.0 |
| Comparative Example 3 | 24.5 × 17.4 × 30.0 | 4.35 | 20.2 × 15.1 × 25.9 | Damaged during working |
| Comparative Example 4 | 24.5 × 17.4 × 26.5 | 3.80 | 19.7 × 14.8 × 23.3 | Unable to work |
| Comparative Example 5 | 24.5 × 17.4 × 30.0 | 4.29 | 20.1 × 15.1 × 25.9 | Unable to Work |
| Comparative Example 6 | 24.5 × 17.4 × 30.0 | 4.32 | 20.3 × 15.2 × 25.8 | 19.6 × 15.4 × 25.0 |

TABLE 2-continued

| No. | Green Body Size (mm)[1] | Density (g/cm³) | Size of Sintered Body[1] (mm) Before Working | After Working |
|---|---|---|---|---|
| Comparative Example 7 | 24.5 × 17.4 × 30.0 | 3.78 | 20.1 × 15.0 × 25.9 | 19.6 × 15.4 × 25.0 |
| Comparative Example 8 | 24.5 × 17.4 × 30.0 | 3.74 | 20.0 × 14.9 × 26.1 | 19.6 × 15.4 × 25.0 |

Note:
[1]The size was outer diameter × inner diameter × height.

TABLE 3

| No. | Peak Value of $B_0$[1] ($\times 10^{-1}$ T) | Magnetic Properties Br[2] (kG) | iHc[3] (kOe) | (BH)max[4] (MGOe) |
|---|---|---|---|---|
| Example 3 | 4.5 (4 poles) | 13.4 | 16.0 | 41.1 |
| Example 4 | 4.5 (4 poles) | 13.4 | 16.4 | 41.2 |
| Example 5 | 4.6 (4 poles) | 13.5 | 15.8 | 41.6 |
| Example 6 | 5.2 (16 poles) | 13.6 | 15.5 | 42.2 |
| Example 7 | 4.3 (8 poles) | 13.4 | 16.2 | 41.0 |
| Example 8 | 2.9 (8 poles) | 12.2 | 23.5 | 34.5 |
| Comparative Example 3 | Not measured | 13.4 | 16.9 | 41.3 |
| Comparative Example 4 | Not measured | 13.3 | 16.4 | 40.2 |
| Comparative Example 5 | Not measured | 13.4 | 16.2 | 41.1 |
| Comparative Example 6 | 3.2 (4 poles) | 11.8 | 18.3 | 29.5 |
| Comparative Example 7 | 2.9 (8 poles) | 11.4 | 24.0 | 28.6 |
| Comparative Example 8 | 3.1 (8 poles) | 11.8 | 23.8 | 31.0 |

Note
[1]$B_0$ was a surface magnetic flux density measured in the axial direction of a magnetic pole, and the number of magnetic poles are shown in the parentheses.
[2]$\times 10^{-1}$ T.
[3]×79.6 kA/m.
[4]×7.96 kJ/m³.

EXAMPLE 9

Coarse powder for an R—Fe—B permanent magnet having a composition by mass of 20.50% of Nd, 9.25% of Pr, 0.25% of Dy, 1.03% of B, 0.08% of Al, 2.00% of Co, 0.10% of Cu, 0.13% of O, 0.04% of C, and 0.02% of N, the balance being Fe, was charged into a jet mill. After replacing an atmosphere in the jet mill with a nitrogen gas, the coarse powder was finely pulverized at a pressure of $6.9\times 10^5$ Pa (7.0 kgf/cm²) and at a coarse powder supply rate of 20 kg/hr. The resultant fine powder was recovered directly in a mineral oil ("Super Sol PA30," available from Idemitsu Kosan Co., Ltd.) disposed at an outlet of the jet mill without contact with the air, to form a slurry.

This mineral oil was mixed with a 5-%-by-rrass solution of sodiun hypophosphite in glycerin in advance, such that the ratio of sodium hypophosphite to the mineral oil was 0.2% by mass. The mass ratio of the fine powder to the mineral oil was 1:3. The average diameter of the fine powder was 4.7 μm. The slurry thus produced was injected under pressure into a die shown in FIG. 2, in which an angle θ between the axis of a slurry-injecting aperture 5 and a radius of a die core 4 was 45°. The intensity of a radially oriented magnetic field applied to the cavity was 239 kA/m (about 3 kOe), and the slurry injection pressure was $2.9\times 10^5$ Pa (about 3 kgf/cm²). After injecting the slurry, wet molding was conducted under a pressure of $3.9\times 10^7$ Pa (about 0.4 ton/cm²) in an oriented magnetic field whose intensity was maintained at 239 kA/m (about 3 kOe), to obtain a green body of an outer diameter of 25.3 mm, an inner diameter of 17.5 mm and a height of 21.8 mm. The density of the green body was 4.40 g/cm³.

This green body was subjected to an oil-removing treatment at 180° C. under a reduced pressure of 6.7 Pa (about $5.0\times 10^{-2}$ Torr) for 4 hours, and then sintered at 1040° C. under a reduced pressure of $6.7\times 10^{-2}$ Pa (about $5.0\times 10^{-4}$ Torr) for 3 hours. The resultant sintered body had a size of an outer diameter of 20.6 mm, an inner diameter of 15.3 mm and a height of 18.8 mm and a density of 7.56 g/cm³. The sintered body was heat-treated at 480° C. for 2 hours. This sintered body was finished by machining to a size of an outer diameter of 20.1 mm, an inner diameter of 15.9 mm and a height of 17.2 mm. A yield [(the weight of the sintered body after working/the weight of the sintered body before working)×100%] was 72.7%. The yield may be called "working ratio."

Figure 7:
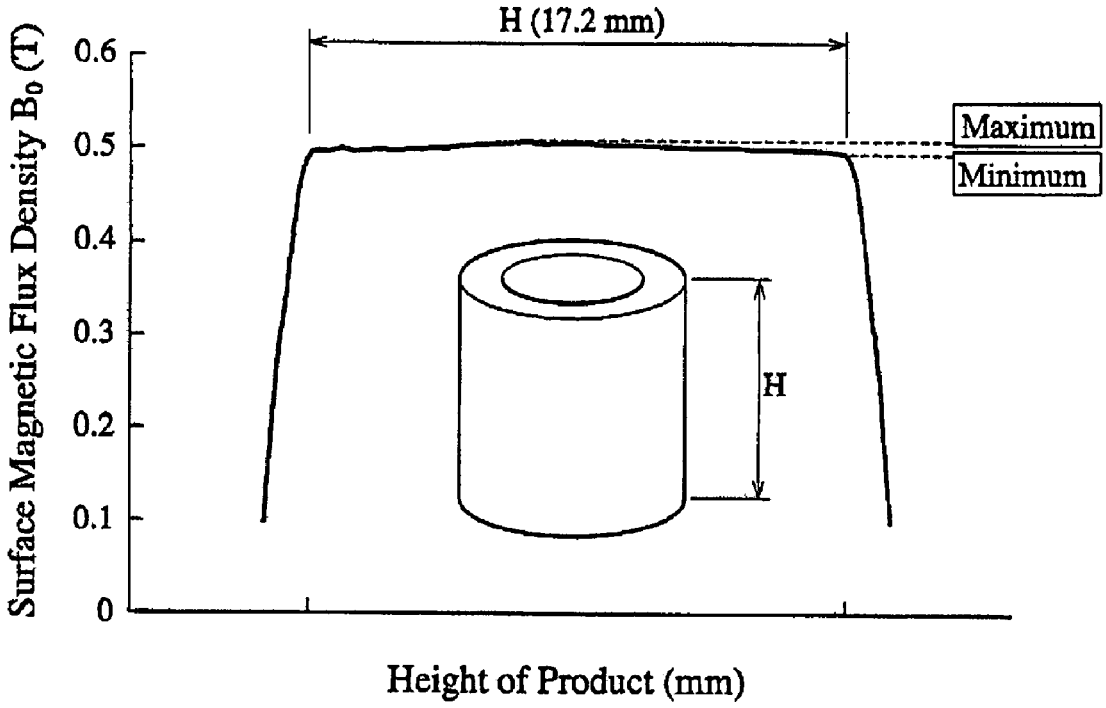
FIG. 7 is a graph showing the surface magnetic flux density distribution of the ring magnet of Example 9.

The surface magnetic flux density $B_0$ of the ring magnet magnetized to have four magnetic poles was measured by a hole sensor probe in the axial direction of a magnetic pole on an outer circumferential surface of the ring magnet. The peak value (maximum) of the surface magnetic flux density $B_0$, and the variation of the surface magnetic flux density $B_0$, which was represented by [(maximum of $B_0$−minimum of $B_0$)/maximum of $B_0$]×100 (%), were detennined from the measurement results of the surface magnetic flux density $B_0$. The results are shown in Table 4 and FIG. 7. In FIG. 7, the ordinate axis indicates a surface magnetic flux density $B_0$. (T) in the axial direction of a magnetic pole of the ring magnet, and the abscissa axis indicates a distance (mm) that the probe moved it the axial direction of the ring magnet. The distance H corresponds to the length (17.2 mm) of the ring magnet in its axial direction. As, is clear from Table 4, the surface magnetic flux density $B_0$ had a high peak value and a small variation.

Figure 8:
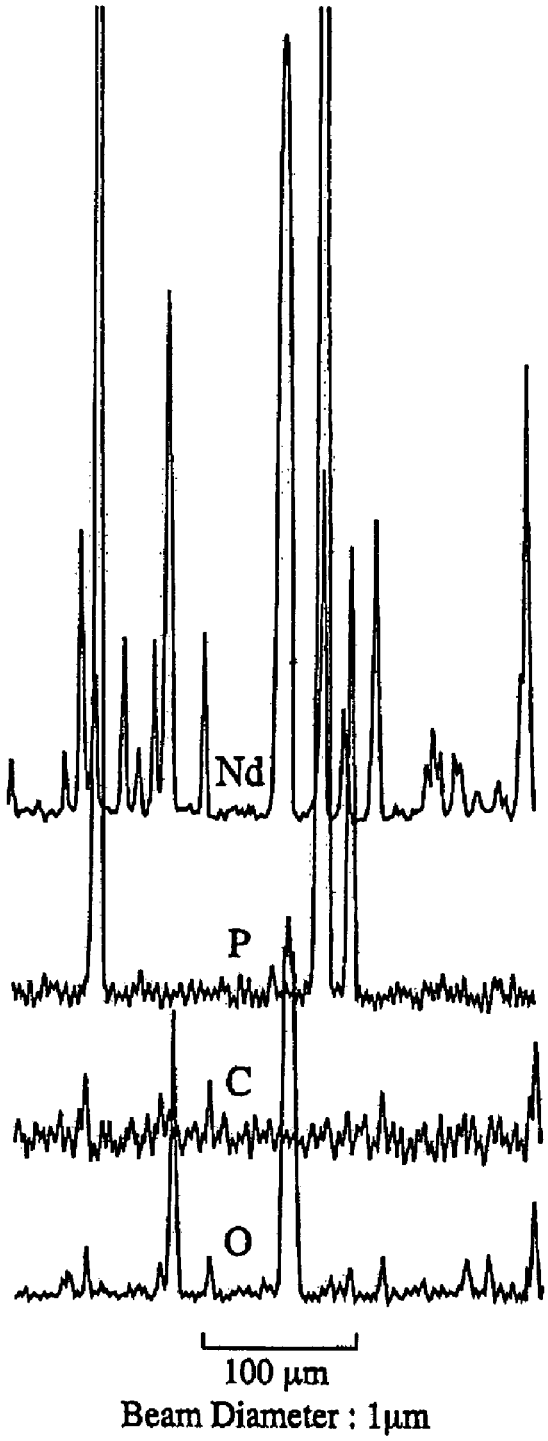
FIG. 8 is a graph showing the line analysis results of EPMA in the sintered body of Example 9.

Eight test pieces 21*b* of 4 mm×7 mm×1 mm were cut out from the sintered body 20 produced in the same manner, as shown in FIG. 3 and stacked in a thickness direction to measure their magnetic properties. As a result, it was confirmed that they had high magnetic properties as shown in Tables 4 and 5. The composition analysis of the sintered body indicated that it had a composition by mass of 20.50% of Nd, 9.25% of Pr, 0.25% Dy, 1.03% of B, 0.08% of Al, 2.00% of Co, 0.10% of Cu, 0.15% of O, 0.06% of C, 0.05% of N, and 0.018% of P, the balance being Fe. The line analysis of EPMA of the test piece 21*b* indicated that there were peaks of P as shown in FIG. 8. It is clear from FIG. 8 that P existed mainly in a rare earth-rich phase of crystal grain boundaries

EXAMPLE 10

The same coarse powder as in Example 9 was finely pulverized and recovered in a mineral oil ("Super Sol PA30," available from Idermitsu Kosani Co., Ltd.) in the same manner as in Example 9, to form a slurry. The mass ratio of the mineral oil to the fine powder was 1:3. The resultant fine powder had an average diameter of 4.6 μm. This slurry was mixed with a 10-%-by-mass solution of sodium hypophosphite in ethanol, such that the ratio of sodium hypophosphite to the mineral oil was 0.4% by mass. This slurry was injected under pressure into a die cavity, in which an angle θ between the axis of the slurry-injecting aperture and the radius of the die core was 30°, and wet-molded in a magnetic field in the same mariner as in Example 9, to obtain a green body of an outer diameter of 25.3 mm, an inner diameter of 17.5 mm and a height of 21.8 mm. The density of the green body was 4.35 g/cm$^3$. 123 green bodies were thus produced per one hour. The yield of the product was 72.9%.

This green body was subjected to oil removal and sintering in the same manner as in Example 9 to obtain a sintered body of an outer diameter of 20.6 mm, an inner diameter of 15.3 mm and a height of 18.75 mm. The density of the sintered body was 7.55×g/cm$^3$. This sintered body was heat-treated at 480° C. for 2 hours. This sintered body was finished by machining to a size of an outer diameter of 20.1 mm, an inner diameter of 15.9 mm and a height of 17.2 mm. After forming four magnetic poles by magnetization, the surface magnetic flux density $B_0$ was measured in the axial direction of a magnetic pole in the same manner as in Example 9. As a result, it was confirmed that the surface magnetic flux density $B_0$ had a high peak value as shown in Table 4. The calculation of the variation of the surface magnetic flux density $B_0$ in an axial direction indicated that it was small as shown in Table 4.

Figure 9:
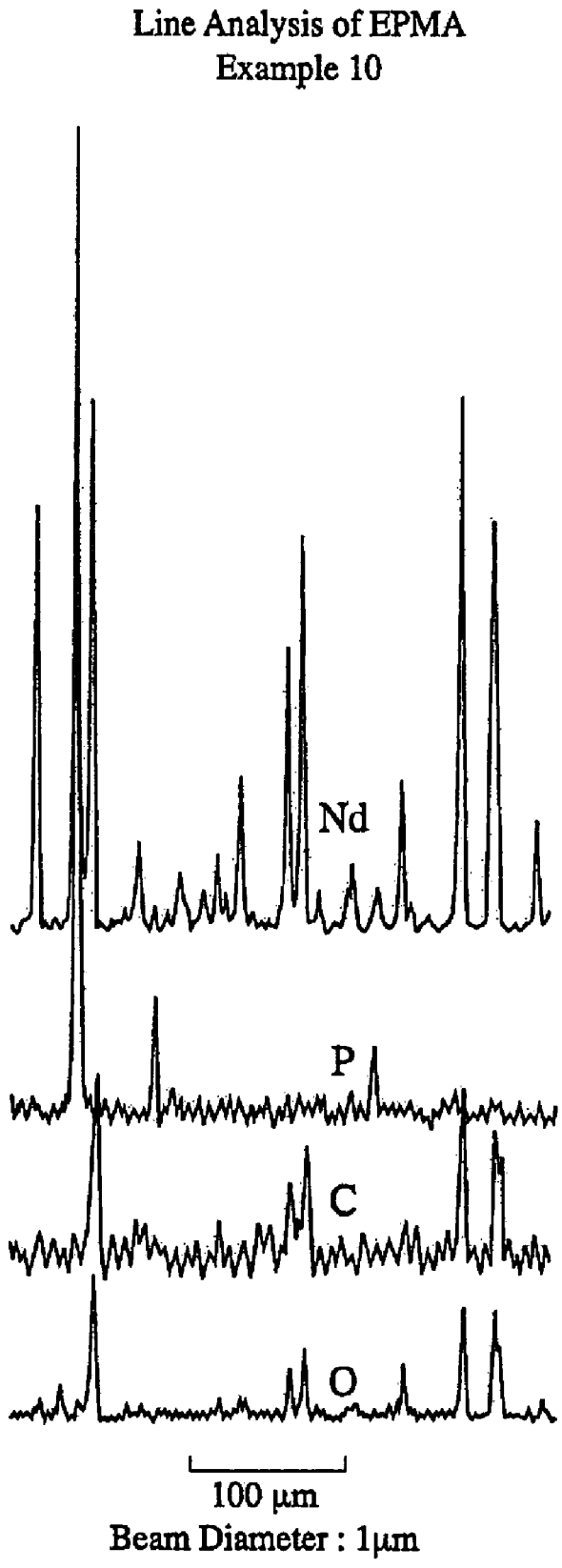
FIG. 9 is a graph showing the line analysis results of EPMA in the sintered body of Example 10.

As shown in FIG. 3, a test piece was cut out from the sintered body in the same manner as in Example 9. The measurement results of magnetic properties are shown in Table 5. The composition analysis of the sintered body indicated that it had a composition by mass of 20.50% of Nd, 9.25% of Pr, 0.25% of Dy, 1.03% of B, 0.08% of Al, 2.00% of Co, 0.10% of Cu, 0.16% of O, 0.07% of C, 0.06% of N, and 0.037% of P, the balance being Fe. As a result of the line analysis of EPMA of this sintered body, the peaks of P were confirmed as shown in FIG. 9.

EXAMPLE 11

The slurry produced in Example 9 was injected under pressure into a die cavity, in which an angle θ between the axis of the slurry-injecting aperture and the radius of the die core was 60°, and wet-molded in a magnetic field in the same manner as in Example 9. In this Example, the size of the die cavity was changed. The intensity of a radially oriented magnetic field applied to the cavity was 398 kA/m (about 5 kOe), and the injection pressure was 5.9×10$^5$ Pa (about 6 kg/cm$^2$). After injecting the slurry, wet molding was conducted under a pressure of 7.8×10$^7$ Pa (about 0.8 ton/cm$^2$) in an oriented magnetic field, whose intensity was maintained at 398 kA/m (about 5 kOe), to obtain a green body of an outer diameter of 33.4 mm, an inner diameter of 24.3 mm and a height of 55.1 mm. 125 green bodies were produced per one hour. The density of the green body was 4.45 g/cm$^3$.

This green body was subjected to oil removal and sintering in the same manner as in Example 9, to obtain a sintered body of an outer diameter of 27.4 mm, an inner diameter of 21.1 mm and a height of 47.4 mm. The density of the sintered body was 7.57 g/cm$^3$. The sintered body was heat-treated at 480° C. for 2 hours. This sintered body was finished by machining to a size of an outer diameter of 26.8 mm, an inner diameter of 21.8 mm and a height of 45.0 mm. The yield of the product was 75.5%.

The sintered body was magnetized to have four magnetic poles, and its surface magnetic flux density was measured in the axial direction of a magnetic pole. The surface magnetic flux density had a high peak value and small variation as shown in Table 4. Eight test pieces of4 mm×7 mm×1 mm cut out from the sintered body were stacked in a thickness direction to measure their magnetic properties. As a result, it was confirmed that they had high magnetic properties as shown in Table 5.

EXAMPLE 12

The slurry produced in Example 11 was injected under a pressure of 3.9×10$^5$ Pa (about 4 kgf/cm$^2$) into a die cavity, to which a radially oriented magnetic field of 159 kA/m (about 2 kOe) was applied, and wet-molded in a magnetic field in the same manner as in Example 11. After 0.5 seconds from the start of slurry injection, the intensity of the oriented magnetic field was increased to 318 kA/m (about 4 kOe), and after injecting, wet molding was conducted in a magnetic field, whose intensity was kept to the above level, to obtain a green body of an outer diameter of 33.4 mm, an inner diameter of 24.3 mm and a height of 54.8 mm. The density of the green body was 4.45 g/cm$^3$. 121 green bodies were produced per one hour.

This green body was subjected to oil removal and sintering in the same manner as in Example 9, to obtain a sintered body of an outer diameter of 27.4 mm, an inner diameter of 21.1 mm and a height of 47.1 mm. The density of the sintered body was 7.57 g/cm$^3$. This sintered body was heat-treated in the same manner as in Example 9, and machined to a size of an outer diameter of 26.8 mm, an inner diameter of 21.8 mm and a height of 45.0 mm. The yield of the product was 6.0%.

After magnetization to have four magnetic poles, the surface magnetic flux density $B_0$ was measured. As a result, the surface magnetic flux density $B_0$ had a high peak value and a small variation as shown in Table 4, The test piece cut out in the same manner as in Example 9 had high magnetic properties as shown in Table 5.

EXAMPLE 13

The slurry produced in Example 9 was injected under pressure into a die cavity, in which an angle θ between the axis of-the slurry-injecting aperture and the radius of the die core was 15°, and wet-molded in a magnetic field in the same manner as in Example 9. In this Example, the size of the die cavity was changed. The intensity of the radially oriented magnetic field applied to the cavity was 223 kA/m (2.8 kOe), and the injection pressure was 3.9×10$^5$ Pa (about 4 kg cm$^2$). After injecting the slurry, wet molding was conducted under a pressure of 3.9×10$^7$ Pa (about 0.4 ton/cm$^2$) in an oriented magnetic field, whose intensity was kept at 223 kA/m (2.8 kOe), to obtain a green body of an outer diameter of 17.9 mm, an inner diameter of 11.1 mm and a height of 16.4 mm. The density of the green body was 4.40 g/cm$^3$. 140 green bodies were produced per one hour.

This green body was subjected to oil removal and sintering in the same manner as in Example 9, to obtain a sintered body of an outer diameter of 14.6 mm, an inner diameter of 9.6 mm and a height of 14.2 mm. The density of the sintered body was 7.58 g/cm$^3$. The sintered body was heat-treated at 480° C. for 2 hours. This sintered body was finished by machining to a size of an outer diameter of 14.0 mm, an inner diameter of 10.0 mm and a height of 12.5 mm. The yield of the product was 69.80%.

The sintered body was magnetized to have fours magnetic poles, and its surface magnetic flux density was measured in the axial direction of a magnetic pole. As a result, the surface magnetic flux density had a high peak value and a small variation as shown in Table 4. Eight test pieces of 3 mm×7 mm×1 mm cut out from the sintered body were stacked in a thickness direction to measure their magnetic properties. As a result, it was confirmed that they had high magnetic properties as shown in Table 5.

COMPARATIVE EXAMPLE 9

The same coarse powder as in Example 9 was finely pulverized and recovered in a mineral oil ("Super Sol PA30," available from Idemitsu Kosan Co., Ltd.) in the same manner as in Example 9, to form a slurry. The mass ratio of the mineral oil to the fine powder was 1:3. The resultant fine powder had an average diameter of 4.6 μm. Any of the mineral oil and the slurry was not mixed with a solution of sodium hypophosphite in glycerin or ethanol. This slurry was injected under pressure and wet-molded in a magnetic field in the same manner as in Example 9. However, because of poor fluidity of the slurry and thus a low filling ratio to the die cavity, the resultant green body had a size of an outer diameter of 25.3 mm, an inner diameter of 17.5 mm and a height of 19.5 mm. The density of the green body was 3.85 g/cm$^3$. 116 green bodies were produced per one hour.

Figure 10:
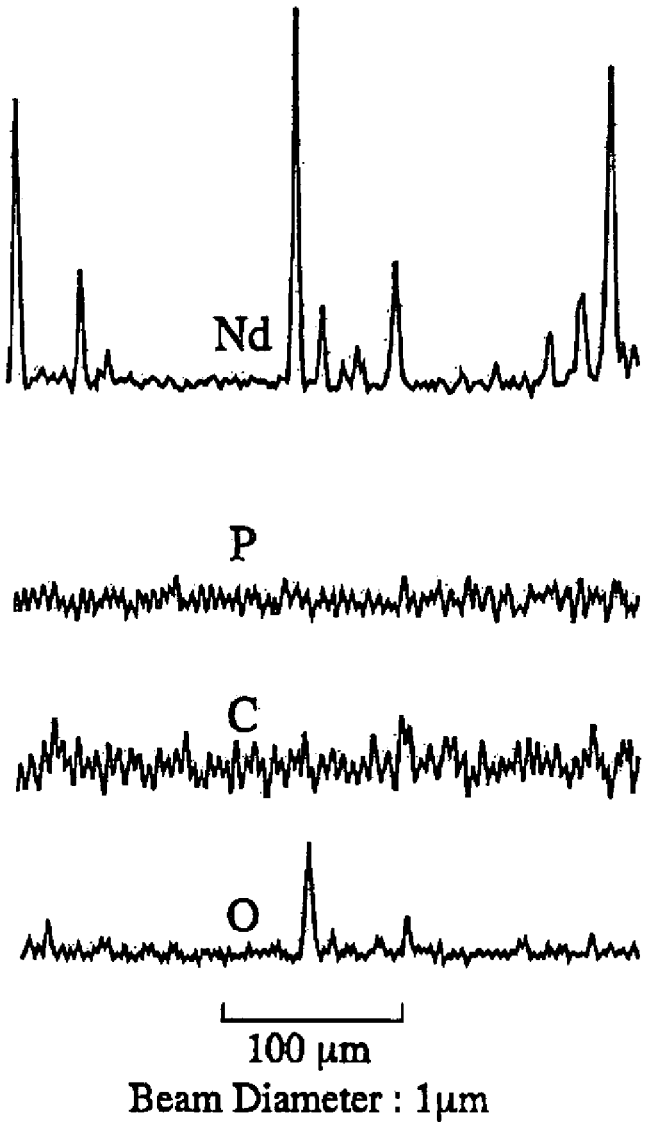
FIG. 10 is a graph showing the line analysis results of EPMA in the sintered body of Comparative Example 9.

This green body was subjected to oil removal and sintering in the same manner as in Example 9 to obtain a sintered body of an outer diameter of 20.3 mm, an inner diameter of 15.0 mm and a height of 15.9 mm. The density of the sintered body was 7.55 g/cm$^3$. However, because of a low filling ratio of the slurry, the resultant sintered body was deformed to an elliptical shape in a portion on the side of the upper punch, and thus the sintered body could not be machined to a product size. The sintered body was heat-treated at 480° C. for 2 hours, and eight test pieces of 4 mm×7 mm×1 mm cut out from other portions than the deformed portion were stacked in a thickness direction to measure their magnetic properties. The results are shown in Tables 4 and 5. The composition analysis of the sintered body indicated that it had a composition by mass of 20.50% of Nd, 9.25% of Pr, 0.25% of Dy, 1.03% of B, 0.08% of Al, 2.00% of Co, 0.10% of Cu, 0.15% of O, 0.07% of C, and 0.05% of N, the balance being Fe. The line analysis of EPMA of this sintered body revealed that there were no peaks of P as shown in FIG. 10.

COMPARATIVE EXAMPLE 10

The slurry produced in Example 9 was injected under pressure into a die cavity, in which the axial direction of a slurry-injecting aperture was aligned with a radial direction of the die core (θ=0°), and wet-molded in a magnetic field in the same manner as in Example 9, to obtain a green body of an outer diameter of 25.3 mm, an inner diameter of 17.5 mm and a height of 21.7 mm. The density of the green body was 4.38 g/cm$^3$. 118 green bodies were produced per one hour.

This green body was subjected to oil removal and sintering in the same manner as in Example 9 to obtain a sintered body of an outer diameter of 20.6 mm, an inner diameter of 15.3 mm and a height of 18.7 mm. The density of the sintered body was 7.56 g/cm$^3$. The sintered body had longitudinal cracks at a position opposite to the injection aperture by 180°. Because of cracks, the sintered body could not be machined to a product size. Eight test pieces of 4 mm×7 mm×1 mm cut out from portions free from cracks were stacked in a thickness direction to measure their magnetic properties. The results are shown in Table 5.

COMPARATIVE EXAMPLE 11

Coarse powder for an R—Fe—B permanent magnet having a composition by mass of 22.25% of Nd, 10.00% of Pr, 0.25% of Dy, 1.03% of B, 0.07% of Al, 2.00% of Co, 0.12% of Cu, 0.10% of Ga, 0.15% of O, 0.03% of C, and 0.015% of N. the balance being Fe, was charged into ajet mill. After replacing an atmosphere in the jet mill with a nitrogen gas, the coarse powder was finely pulverized at a pressure of 6.4×105 Pa (6.5 kgf/cm$^2$) and at a coarse powder supply rate of 30 kg/hr. During the fine pulverization, a trace amount of oxygen was introduced into the jet mill to control the oxygen concentration in the nitrogen gas to 0.080-0.120%. The resultant fine powder had a particle size of 4.8 μm, and its composition was, by mass, 22.25% of Nd, 10.00% of Pr, 0.25% of Dy, 1.03% of B, 0.07% of Al, 2.00% of Co, 0.12% of Cu, 0.10% of Ga, 0.52% of O, 0.06% of C, and 0.015% of N, the balance being Fe.

The resultant dry fine powder was charged from above into the same die cavity as in Example 9 except for having no slurry injection aperture and a ⅓ depth without mixed with a mineral oil, to produce a first green body under a pressure of 7.8×10$^7$ Pa (about 0.8 ton/cm$^2$) in an oriented magnetic field of 398 kA/m (about 5 kOe). Next, with a lower punch moved down, dry fime powder was charged into the die cavity again such that it was accumulated on the first green body, thereby producing a second green body having the same volume as that of the first green body integrally with the first green body under a pressure of 7.8×10$^7$ Pa (0.8 ton/cm$^2$). Further, the third filling and molding were conducted by the same method to integrally produce a third green body of the same volume. The resultant integral green body had a size of an outer diameter of 25.3 mm, an inner diameter of 17.5 mm and a height of 21.5 mm. The density of the green body was 3.80 g/cm$^3$. 48 green bodies were produced per one hour.

This green body was sintered at 1070° C. under a reduced pressure of 6.7×10$^{-3}$ Pa (about 5×10$^{-5}$ Torr) for 3 hours, to obtain a sintered body of an outer diameter of 20.7 mm, an inner diameter of 15.4 mm and a height of 18.8 mm. The density of the sintered body was 7.52 g/cm$^3$. This sintered body was heat-treated at 480° C. for 2 hours. It was further machined to a size of an outer diameter of 20.1 mm, an inner diameter of 15.9 mm and a height of 17.2 mm. The yield of the product was 72.3%.

Figure 11:
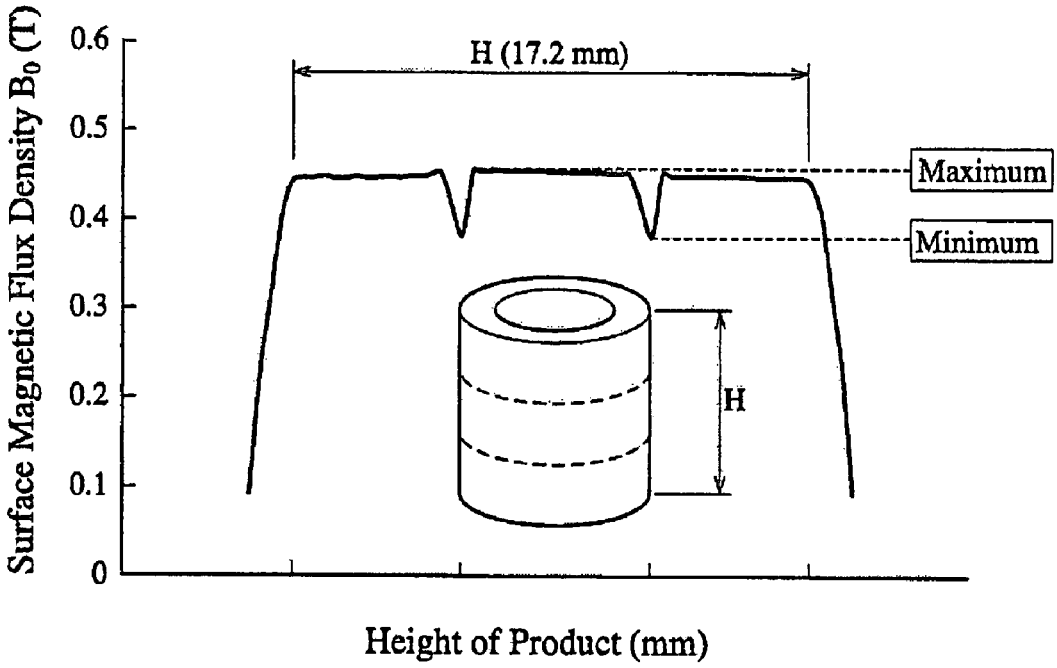
FIG. 11 is a graph showing the surface magnetic flux density distribution of the ring magnet of Comparative Example 11.

This sintered body was magnetized to have four magnetic poles, and its surface magnetic flux density was measured in the axial direction of a magnetic pole. As shown in Table 4 and FIG. 11, the surface magnetic flux density of Comparative Example 11 had a lower peak value than that of Example 9 with large variations at three-piece molding junctions. Eight test pieces of 4 mm×7 mm×1 mm cut out from the sintered body were stacked in a thickness direction to measure their magnetic properties. As a result, it was confirmed that the magnetic properties of Comparative Example 11 were lower than those of Example 9 as shown in Table 5. In addition, the sintered body had a surface magnetic flux density $B_0$ locally low at three-piece molding junctions, so that it exhibited poorer cogging characteristics than those of Example 9 when assembled in a motor.

COMPARATIVE EXAMPLE 12

Dry fine powder was charged from above into the same die cavity as in Comparative Example 11 except for having no slurry injection aperture and a ⅓ depth without mixed with a mineral oil, to produce a first green body under a pressure of $7.8\times10^7$ Pa (about 0.8 ton/cm$^2$) in an oriented magnetic field of 478 kA/m (about 6 kOe). Next, with a lower punch moved down, dry fine powder was charged into the die cavity again such that it was accumulated on the first green body, to produce a second green body having the same volume as that of the first green body integrally with the first green body under a pressure of $7.8\times10^7$ Pa (0.8 ton/cm$^2$). Further, the third filling and molding were conducted by the same method to integrally produce a third green body of the same volume.

The resultant integral green body had a size of an outer diameter of 33.4 mm, an inner diameter of 24.3 mm and a height of 54.6 mm. The density of the green body was 3.75 g/cm$^3$. 45 green bodies were produced per one hour.

This green body was sintered at 1070° C. under a reduced pressure of $6.7\times10^{-3}$ Pa (about $5\times10^{-5}$ Torr) for 3 hours, to obtain a sintered body of an outer diameter of 27.3 mm, an inner diameter of 21.4 mm and a height of 47.5 mm. The density of the sintered body was 7.51 g/cm$^3$. This sintered body was heat-treated at 480° C. for 2 hours. It was further machined to a size of an outer diameter of 26.8 mm, an inner diameter of 21.8 mm and a height of 45.0 mm. The yield of the product was 80.1%. This sintered body was magnetized to have four magnetic poles, and its surface magnetic flux density was measured in the axial direction of a magnetic pole. As shown in Table 4, the surface magnetic flux density of Comparative Example 12 had a lower peak value than that of Example 11 with large variations. Eight test pieces of 4 mm×7 mm×1 mm cut out from the sintered body were stacked in a thickness direction to measure their magnetic properties. As a result, it was confirmed that the magnetic properties of Comparative Example 12 were lower than those of Example 11 as shown in Table 5. In addition, the sintered body had a surface magnetic flux density $B_0$ locally low at three-piece molding junctions, so that it exhibited poorer cogging characteristics than those of Example 11 when assembled in a motor.

COMPARATIVE EXAMPLE 13

A mother alloy having a composition by mass of 30.0% of Nd, 0.90% of B, 5.00% of Co, and 0.20% of Ga, the balance being Fe, was charged into a quartz nozzle having an aperture at its bottom, and the inside of the quartz nozzle was evacuated to 0.4 Pa (about $3\times10^{-3}$ Torr). The mother alloy was melted by a high frequency in an atmosphere, into which an Ar gas was introduced to a pressure of $5.3\times10^4$ Pa (about 400 Torr), and the resultant melt was ejected under an Ar pressure of 270 g/cm$^3$ onto a Be—Cu roll rotating at a peripheral speed of 30 m/s. Thus, a thin ribbon alloy having an average thickness of 30 μm was formed.

The thin ribbon alloy was coarsely pulverized to 500 μm or less, and the resultant coarse powder was mixed with 0.2% by mass of flaky graphite and 0.3% by mass a low-melting temperature amorphous bismuth borosilicate glass. The resultant coarse powder mixture was cold-pressed under a pressure of $4.9\times10^8$ Pa (about 5 ton/cm$^2$), to produce a green compact having a density of 5.8 g/cm$^3$. This green compact was hot-pressed at 740° C. and $2\times10^8$ Pa (2 ton/cm$^2$) in vacuum of 0.67 Pa ($5.0\times10^{-3}$ Torr), to produce a sintered body having a density of 7.40 g/cm$^3$. This sintered body was further hot-plastic-worked at 740° C. in vacuum of 0.67 Pa ($5.0\times10^{-3}$ Torr), to produce a cup body having an outer diameter of 22.0 mm, an inner diameter of 14.5 mm and a height of 48.0 mm with a bottom portion as thick as 10 mm. The number of hot plastic working operations for imparting radial anisotropy to the cup body was as small as three per one hour. The bottom portion was cut out from the cup body by machining. Also, an end portion having cracks on the opposite side of the bottom portion was cut out from the cup body. The resultant ring was machined in inner and outer surfaces to a product size of an outer diameter of 20.1 mm, an inner diameter of 15.9 mm and a height of 28.0 mm. The yield of the product to the hot-plastic-worked body was as low as 17.0%.

Figure 12:
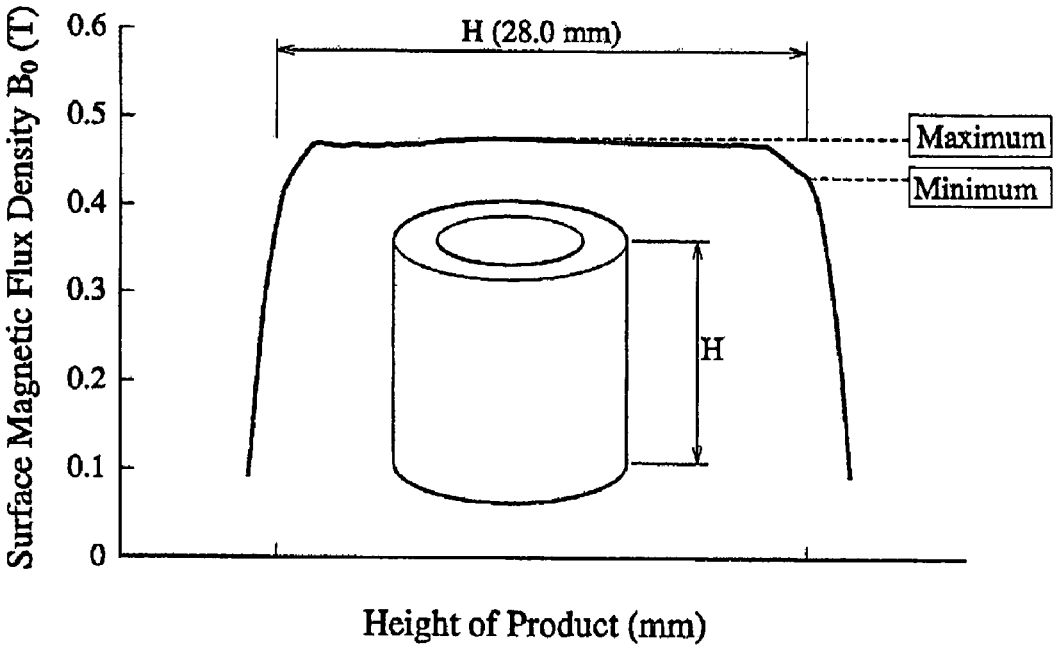
FIG. 12 is a graph showing the surface magnetic flux density distribution of the ring magnet of Comparative Example 13.

This ring magnet was magnetized to have four magnetic poles in the same manner as in Example 9. The surface magnetic flux density of the sintered body was measured. As shown in Table 4 and FIG. 12, the surface magnetic flux density of Comparative Example 13 was low in both axial end portions, and had a lower peak value than that of Example 9 with large variations. The results of measurement of magnetic properties on a test piece of 4 mm×7 mm×1 mm cut out from the product revealed that the magnetic properties of Comparative Example 13 were lower than those of Example 9 as shown in Table 5. The product of Comparative Example 13 suffered from larger cogging than that of Example 9 when assembled in a motor.

COMPARATIVE EXAMPLE 14

A thin ribbon was produced from a mother alloy having a composition by mass of 28.0% of Nd, 0.50% of Ce, 0.90% of B, 3.0% of Co, and 0.15% of Ga, the balance being Fe, in the same manner as in Comparative Example 13, and the resultant thin nbbon was pulverized to coarse powder. This coarse powder was formed into a green compact of 5.7 g/cm$^3$ in the same manner as in Comparative Example 13, and the green compact was hot-pressed at 720° C. in vacuum of 0.4 Pa ($3\times10^{-3}$ Torr) to a density of 7.30 g/cm$^3$. The resultant pressed body was hot-plastic-worked at 720° C. in vacuum of 0.4 Pa ($3\times10^{-3}$ Torr) in the same manner as in Comparative Example 13, to obtain a cup body of an outer diameter of 30.0 mm, an inner diameter of 19.5 mm and a height of 65.0 mm with a bottom portion as thick as 10 mm. Only four hot plastic working operations were conducted per one hour.

A bottom portion was cut off from the cup body by machining. Also, end portions having cracks were cut off from the bottom portion on the opposite side,. The resultant ring was machined in its inner and outer surface to a product size of an outer diameter of 26.8 mm, an inner diameter of 21.8 mm and a height of 45.0 mm. The yield of the product to the hot-plastic-worked body was as low as 29.1%.

This product was magnetized to have four magnetic poles in the same manner as in Example 11. The surface magnetic flux density $B_0$ of the sintered body was measured. As shown in Table 4, the surface magnetic flux density $B_0$ of Comparative Example 14 was low in both axial end portions, and had a lower peak value than that of Example 11 with large variations. The results of measurement of magnetic properties on a test piece of 4 mm×7 mm×1 mm cut out from the product revealed that the magnetic properties of Comparative Example 14 were lower than those of Example 11 as shown in Table 5. The product of Comparative Example 14 suffered from larger cogging than that of Example 11 when assembled in a motor.

TABLE 4

| No. | Green Body | | | Size of Sintered Body[1] (mm) | |
|---|---|---|---|---|---|
| | Size (mm)[1] | Density (g/cm$^3$) | Productivity (/h)[2] | Before Working | After Working |
| Example 9 | 25.3 × 17.5 × 21.8 | 4.40 | 120 | 20.6 × 15.3 × 18.8 | 20.1 × 15.9 × 17.2 |
| Example 10 | 25.3 × 17.5 × 21.8 | 4.35 | 123 | 20.6 × 15.3 × 18.75 | 20.1 × 15.9 × 17.2 |
| Example 11 | 33.4 × 24.3 × 55.1 | 4.45 | 125 | 27.4 × 21.1 × 47.4 | 26.8 × 21.8 × 45.0 |
| Example 12 | 33.4 × 24.3 × 54.8 | 4.45 | 121 | 27.4 × 21.1 × 47.1 | 26.8 × 21.8 × 45.0 |
| Example 13 | 17.9 × 11.1 × 16.4 | 4.40 | 140 | 14.6 × 9.6 × 14.2 | 14.0 × 10.0 × 12.5 |
| Comparative Example 9 | 25.3 × 17.5 × 19.5 | 3.85 | 116 | 20.3 × 15.0 × 15.9 | — |
| Comparative Example 10 | 25.3 × 17.5 × 21.7 | 4.38 | 118 | 20.6 × 15.3 × 18.7 | — |
| Comparative Example 11 | 25.3 × 17.5 × 21.5 | 3.80 | 48 | 20.7 × 15.4 × 18.8 | 20.1 × 15.9 × 17.2 |
| Comparative Example 12 | 33.4 × 24.3 × 54.6 | 3.75 | 45 | 27.3 × 21.4 × 47.5 | 26.8 × 21.8 × 45.0 |
| Comparative Example 13 | — | — | 3 | 22.0 × 14.5 × 48.0 | 20.1 × 15.9 × 28.0 |
| Comparative Example 14 | — | — | 4 | 30.0 × 19.5 × 65.0 | 26.8 × 21.8 × 45.0 |

Note
[1]The size was outer diameter × inner diameter × height.
[2]The number of green bodies produced per one hour.

TABLE 5

| No. | Yield (%) | Peak Value of $B_0$[1] ($\times 10^{-1}$ T) | Variation of $B_0$ (%) | Magnetic Properties Br[2] (kG) | iHc[3] (kOe) | (BH)max[4] (MGOe) |
|---|---|---|---|---|---|---|
| Example 9 | 72.7 | 5.0 (4 poles) | 2.5 | 13.8 | 15.8 | 43.5 |
| Example 10 | 72.9 | 5.1 (4 poles) | 2.7 | 13.9 | 15.5 | 44.3 |
| Example 11 | 75.5 | 5.6 (4 poles) | 3.0 | 14.1 | 15.0 | 45.7 |
| Example 12 | 76.0 | 5.5 (4 poles) | 2.8 | 14.0 | 15.2 | 45.0 |
| Example 13 | 69.8 | 4.6 (4 poles) | 2.6 | 13.7 | 16.4 | 42.5 |
| Comparative Example 9 | — | — | — | 13.7 | 16.1 | 42.8 |
| Comparative Example 10 | — | — | — | 13.8 | 15.7 | 43.4 |
| Comparative Example 11 | 72.3 | 4.5 (4 poles) | 14.5 | 12.6 | 16.7 | 36.1 |
| Comparative Example 12 | 80.1 | 5.0 (4 poles) | 15.0 | 12.7 | 16.5 | 37.2 |
| Comparative Example 13 | 17.0 | 4.7 (4 poles) | 8.0 | 12.9 | 12.3 | 37.0 |
| Comparative Example 14 | 29.1 | 5.2 (4 poles) | 7.5 | 13.1 | 11.0 | 38.6 |

Note
[1]$B_0$ was a surface magnetic flux density measured in the axial direction of a magnetic pole, and the number of magnetic poles are shown in the parentheses.
[2]$\times 10^{-1}$ T.
[3]×79.6 kA/m.
[4]×7.96 kJ/m$^3$.

The sintered permanent magnets of the present invention containing a desired amount of P have an improved coercivity iHc. The method of the present invention can produce radially anisotropic sintered R—Fe—B permanent magnets free from deformation and cracking and excellent in magnetic orientation. The sintered permanent magnets of the present invention are particularly suitable as ring magnets for use in motors, etc.

What is claimed is:

1. A method for producing a radially anisotropic sintered R—Fe—B permanent magnet wherein R is at least one of rare earth elements including Y, comprising the steps of (a) pulverizing a rare earth magnet material to fine powder, and recovering said fine powder directly in a mineral oil, a synthetic oil or their mixture to form a slurry, (b) injecting said slurry under pressure into a ring-shaped die cavity between a hollow cylindrical die member and a solid cylindrical core, in which said slurry is wet-molded in a radially oriented magnetic field, (c) heating the resultant ring-shaped green body under reduced pressure to remove said mineral oil, said synthetic oil or their mixture from said green body, and (d) sintering said green body, which has said mineral oil, said synthetic oil, or their mixture removed, in vacuum, wherein said slurry is injected into said ring-shaped die cavity through an aperture open at an inner surface of said hollow cylindrical die member at an angle θ of 5° to 90°, wherein θ is an angle (right or acute angle) between a center axis of said aperture and a line AO, wherein A is a point at which the center axis of said aperture intersects the inner surface of said hollow cylindrical die member, and O is a center point of said solid cylindrical core.

2. The method for producing a sintered permanent magnet according to claim 1, wherein the oxygen content of said fine powder is more than 0.25% and 0.6% or less by mass.

* * * * *